US012553658B2

(12) United States Patent
Chung et al.

(10) Patent No.: US 12,553,658 B2
(45) Date of Patent: Feb. 17, 2026

(54) STOREHOUSE

(71) Applicant: LG ELECTRONICS INC., Seoul (KR)

(72) Inventors: Myungjin Chung, Seoul (KR); Yoonseong Nam, Seoul (KR); Sounguk Kim, Seoul (KR); Jeongwon Park, Seoul (KR); Kyungseok Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 121 days.

(21) Appl. No.: 18/577,370

(22) PCT Filed: Jul. 6, 2022

(86) PCT No.: PCT/KR2022/009796

§ 371 (c)(1),
(2) Date: Jan. 8, 2024

(87) PCT Pub. No.: WO2023/282639

PCT Pub. Date: Jan. 12, 2023

(65) Prior Publication Data

US 2024/0337431 A1 Oct. 10, 2024

(30) Foreign Application Priority Data

Jul. 8, 2021 (KR) ..... 10-2021-0089690

(51) Int. Cl.
*F25D 23/00* (2006.01)
*F25D 11/00* (2006.01)

(52) U.S. Cl.
CPC ..... *F25D 23/006* (2013.01); *F25D 11/00* (2013.01)

(58) Field of Classification Search
CPC ..... F25D 23/006; F25D 11/00; F25D 17/062; F25D 17/08; F25D 19/02; F25D 19/003;
(Continued)

(56) References Cited

U.S. PATENT DOCUMENTS 6,070,424 A 6/2000 Bauman et al.
11,719,484 B2 * 8/2023 Ko ..... F25D 17/065 62/419

(Continued)

FOREIGN PATENT DOCUMENTS

CN 107588590 1/2018
JP 2006-200765 8/2006

(Continued)

OTHER PUBLICATIONS

International Search Report dated Oct. 21, 2022 issued in Application No. PCT/KR2022/009796.

(Continued)

*Primary Examiner* — Hai H Huynh
(74) *Attorney, Agent, or Firm* — KED & ASSOCIATES, LLP

(57) ABSTRACT

The present disclosure relates to a storehouse. In one aspect of the present disclosure, a storehouse may include a first storage space configured to provide a space in which goods are stored within a predetermined temperature or a predetermined temperature range and a second storage space configured to provide a space in which a first heat exchanger is accommodated. The storehouse may include a tray provided adjacent to the second wall defining at least a part of the second storage space and forming a fluid collecting portion configured to store a fluid discharged from the second wall. The second storage space may be fluidly connected to the first storage space.

20 Claims, 13 Drawing Sheets

(58) Field of Classification Search
CPC ..... F25D 21/14; F25D 2321/1411; F25D 2321/1442; F25D 2321/1412; F25D 2321/1441; F25D 2317/0651; F25D 2317/0661
USPC ..... 165/67
See application file for complete search history.

(56) References Cited

U.S. PATENT DOCUMENTS

| | | | |
|---|---|---|---|
| 2007/0214823 | A1 | 9/2007 | Park |
| 2021/0131717 | A1 | 5/2021 | Ko et al. |

FOREIGN PATENT DOCUMENTS

| | | |
|---|---|---|
| JP | 2006-308138 | 11/2006 |
| JP | 2007-085622 | 4/2007 |
| KR | 2003-0027367 | 4/2003 |
| KR | 10-2021-0024925 | 3/2021 |
| WO | WO 2021/086124 | 5/2021 |

OTHER PUBLICATIONS

Extended European Search Report dated Mar. 28, 2025, issued in Application No. 22837991.3.

* cited by examiner

[Fig. 1]
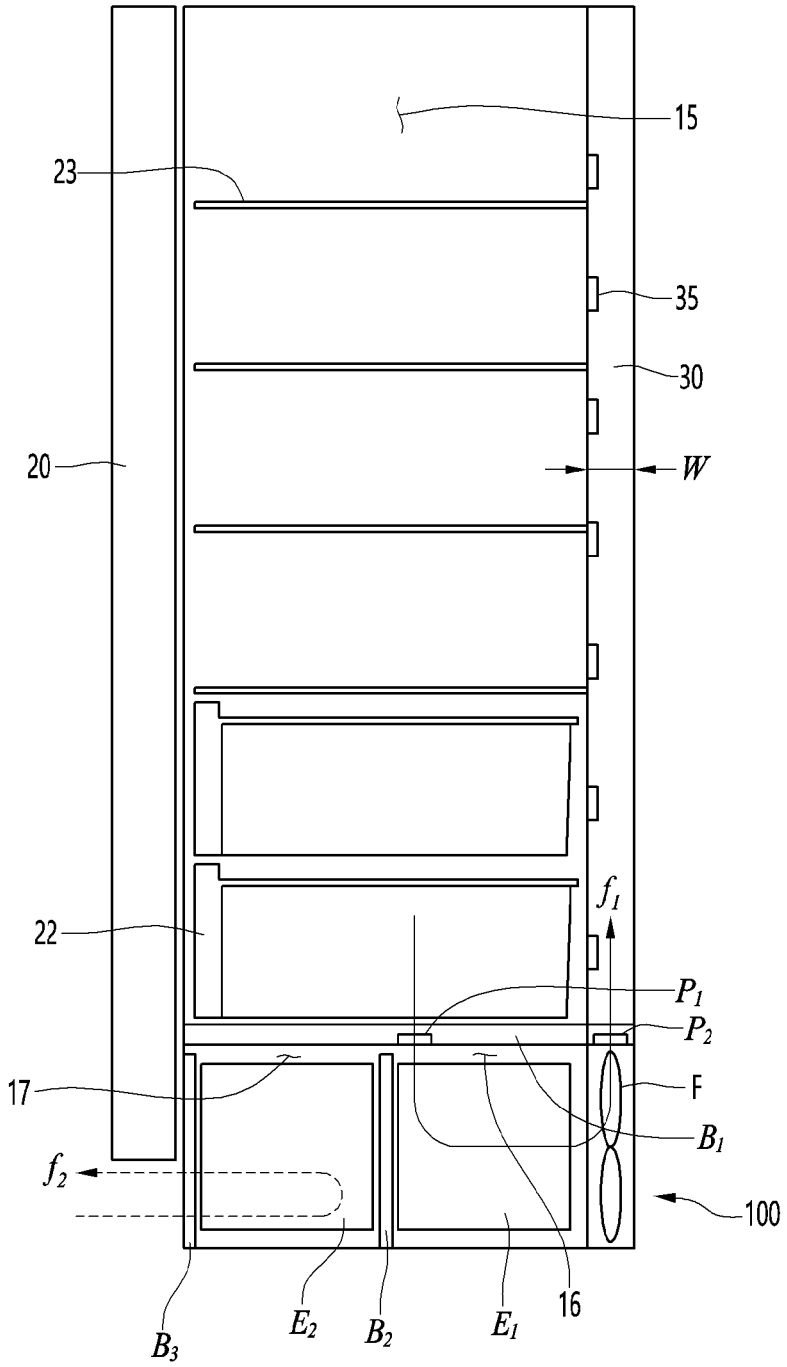

[Fig. 2]
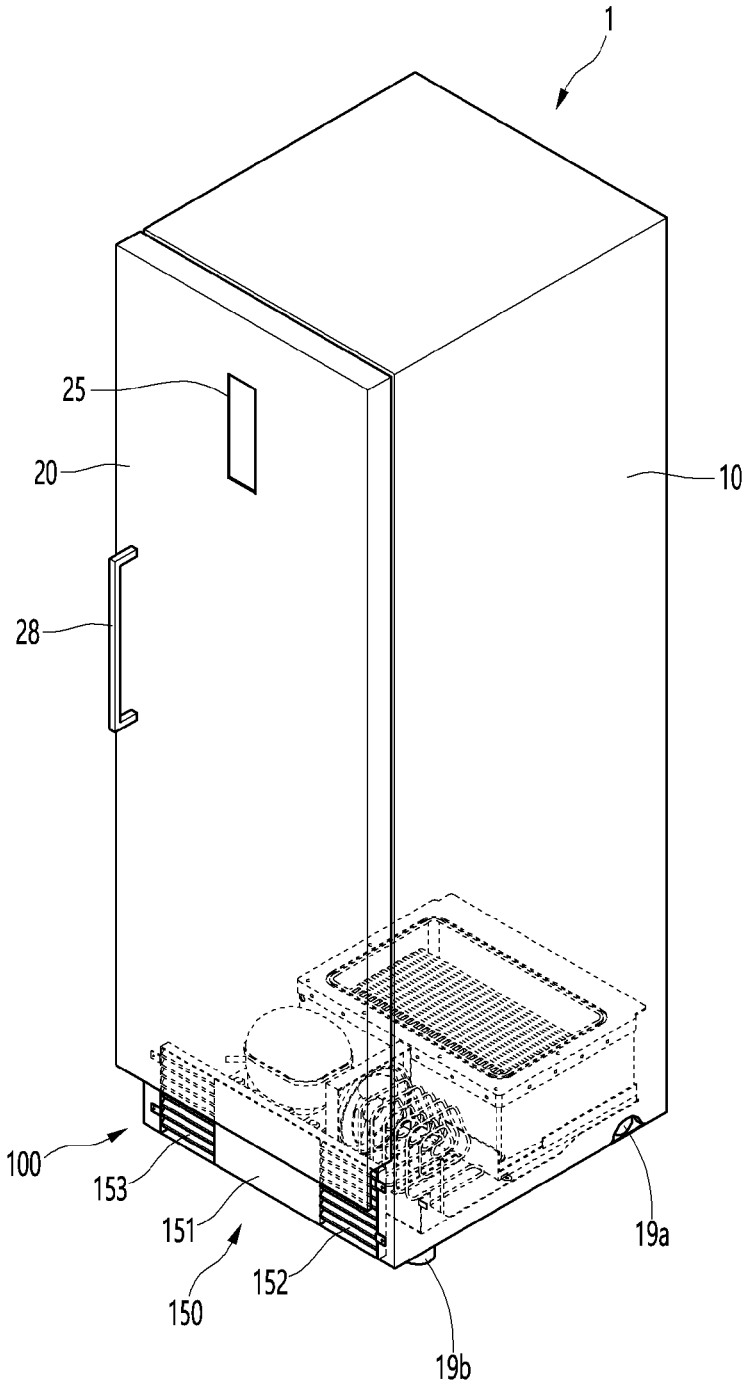

[Fig. 3]
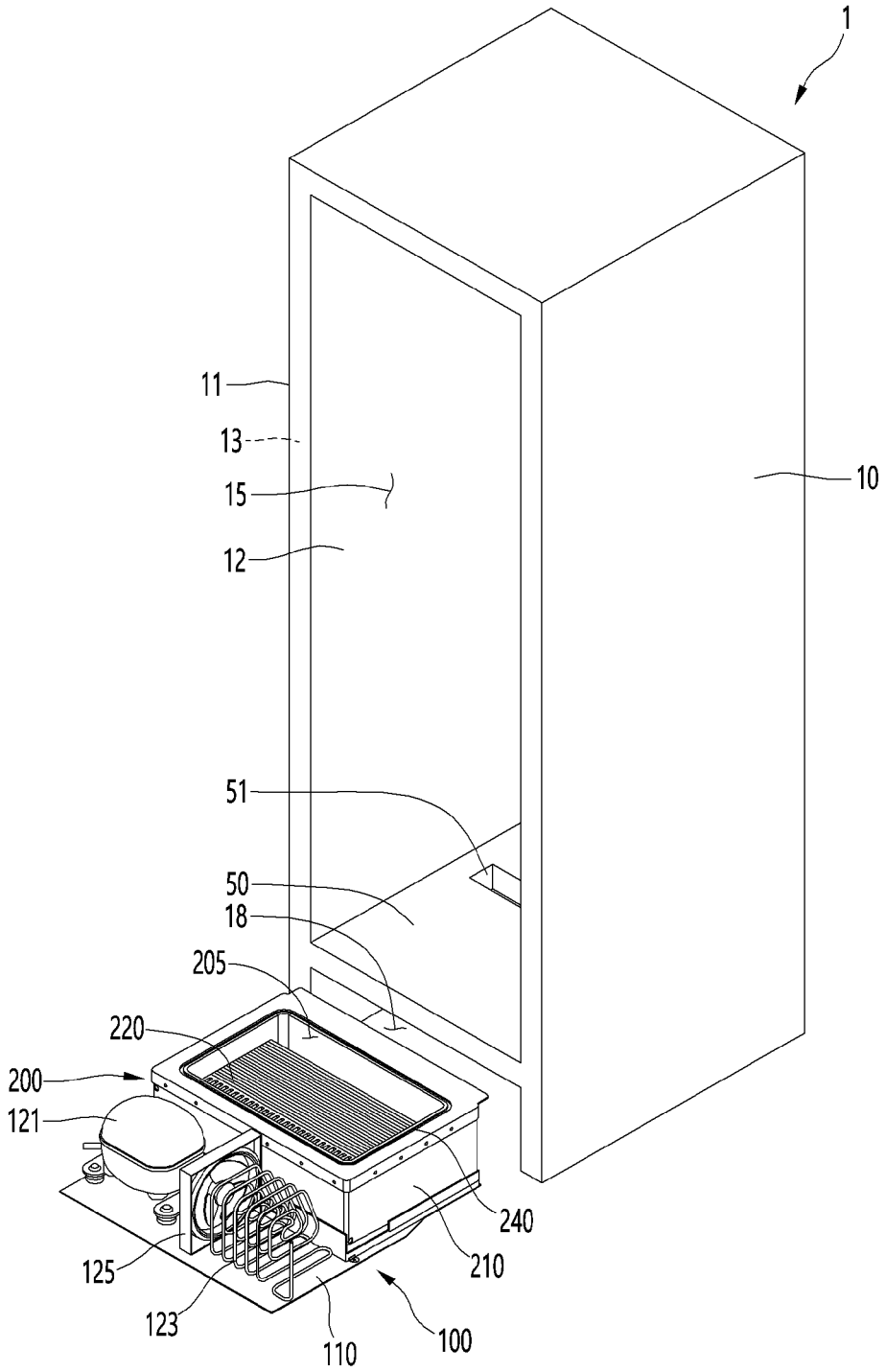

[Fig. 4]
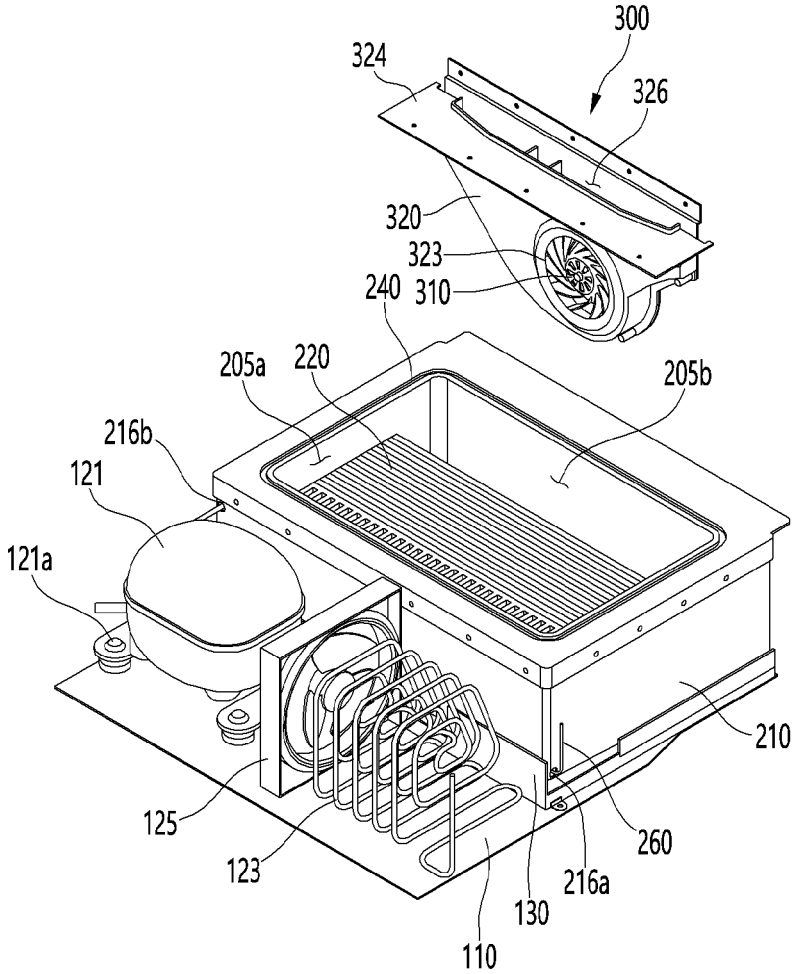

[Fig. 5]
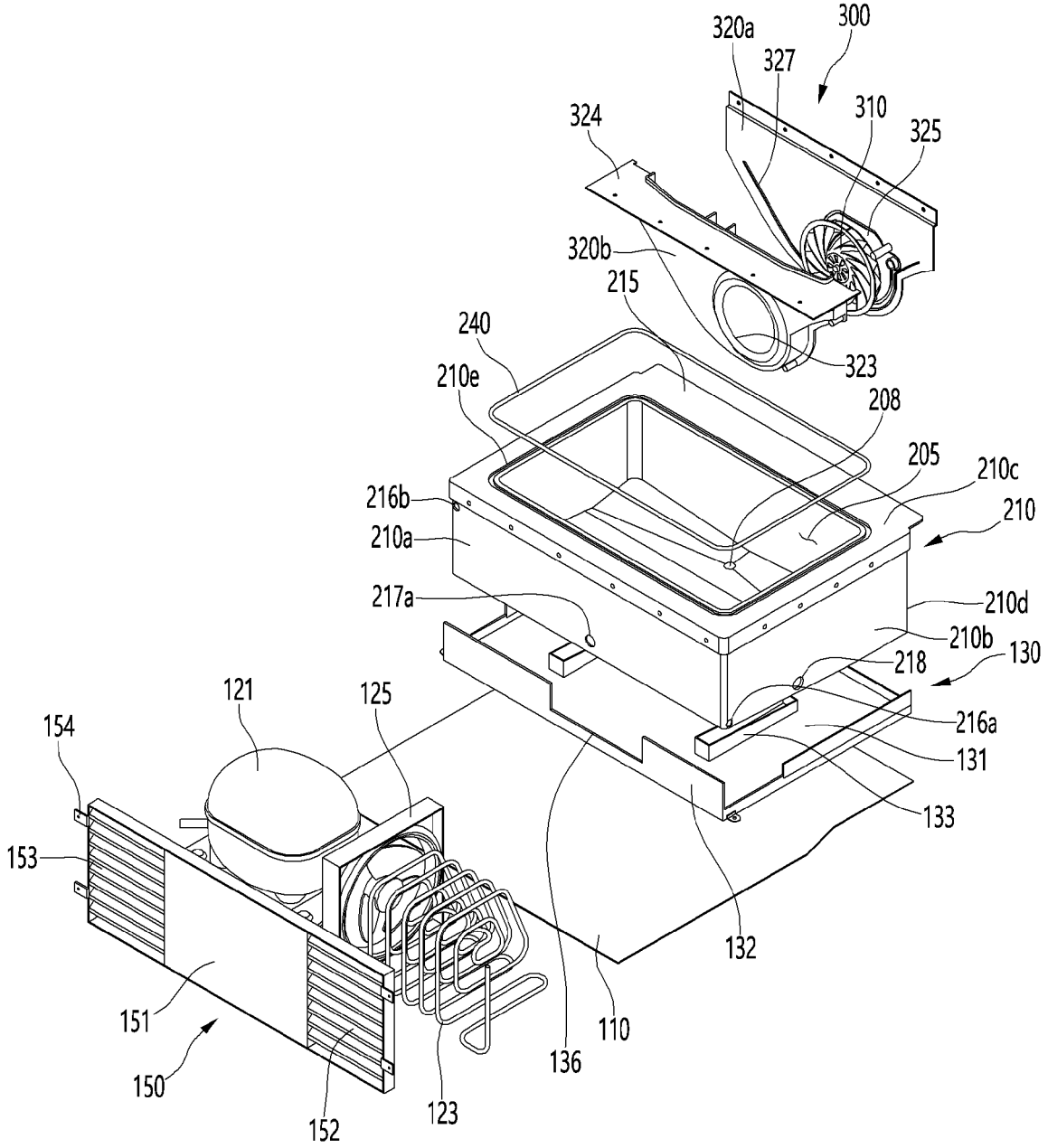

[Fig. 6]
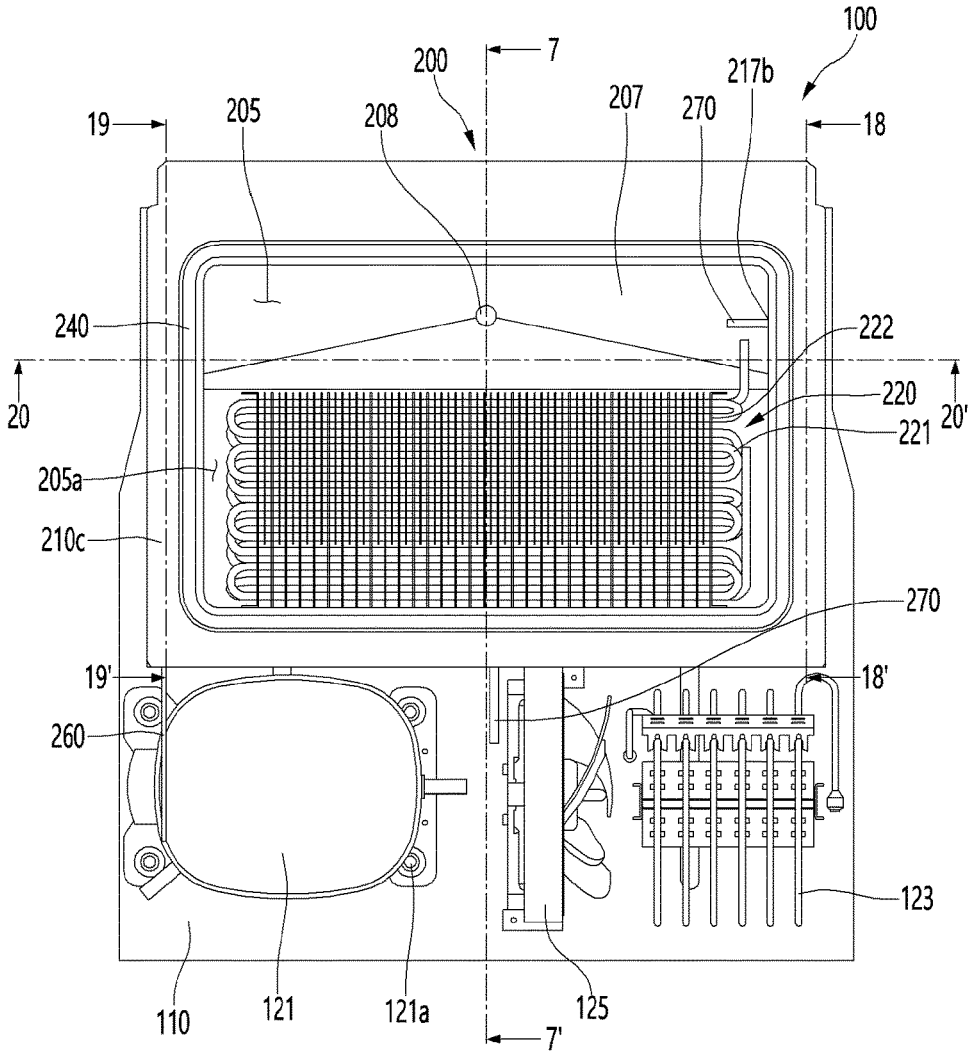
[Fig. 7]
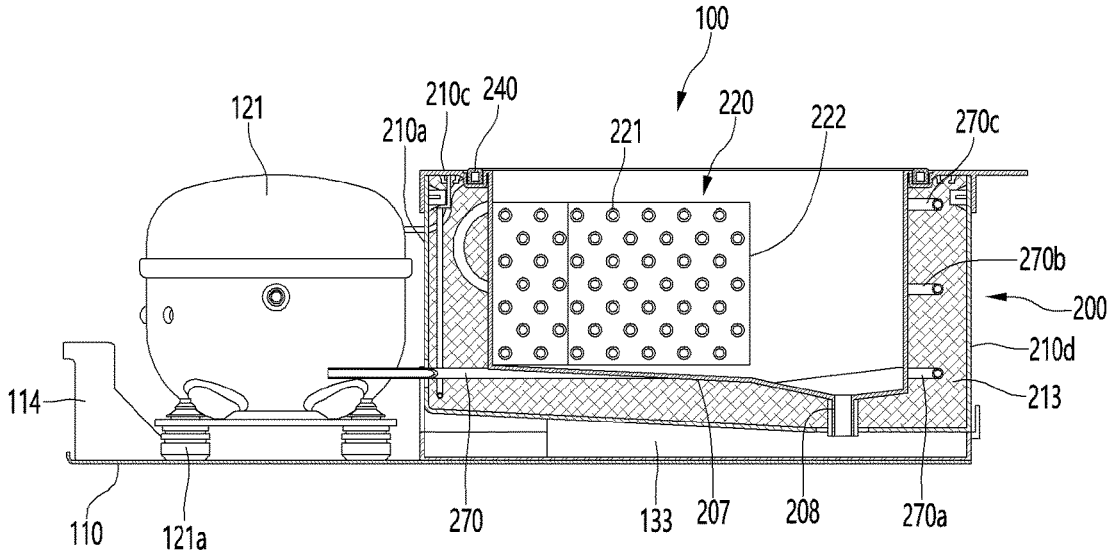

[Fig. 8]
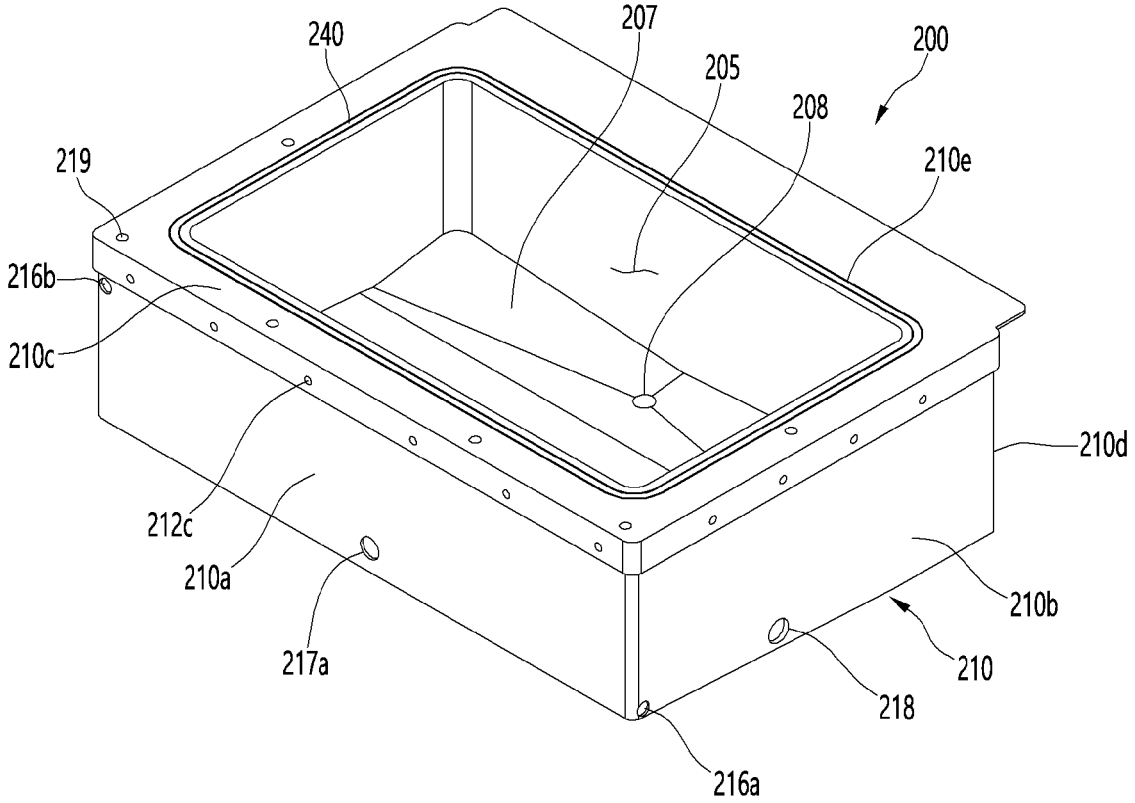

[Fig. 9]
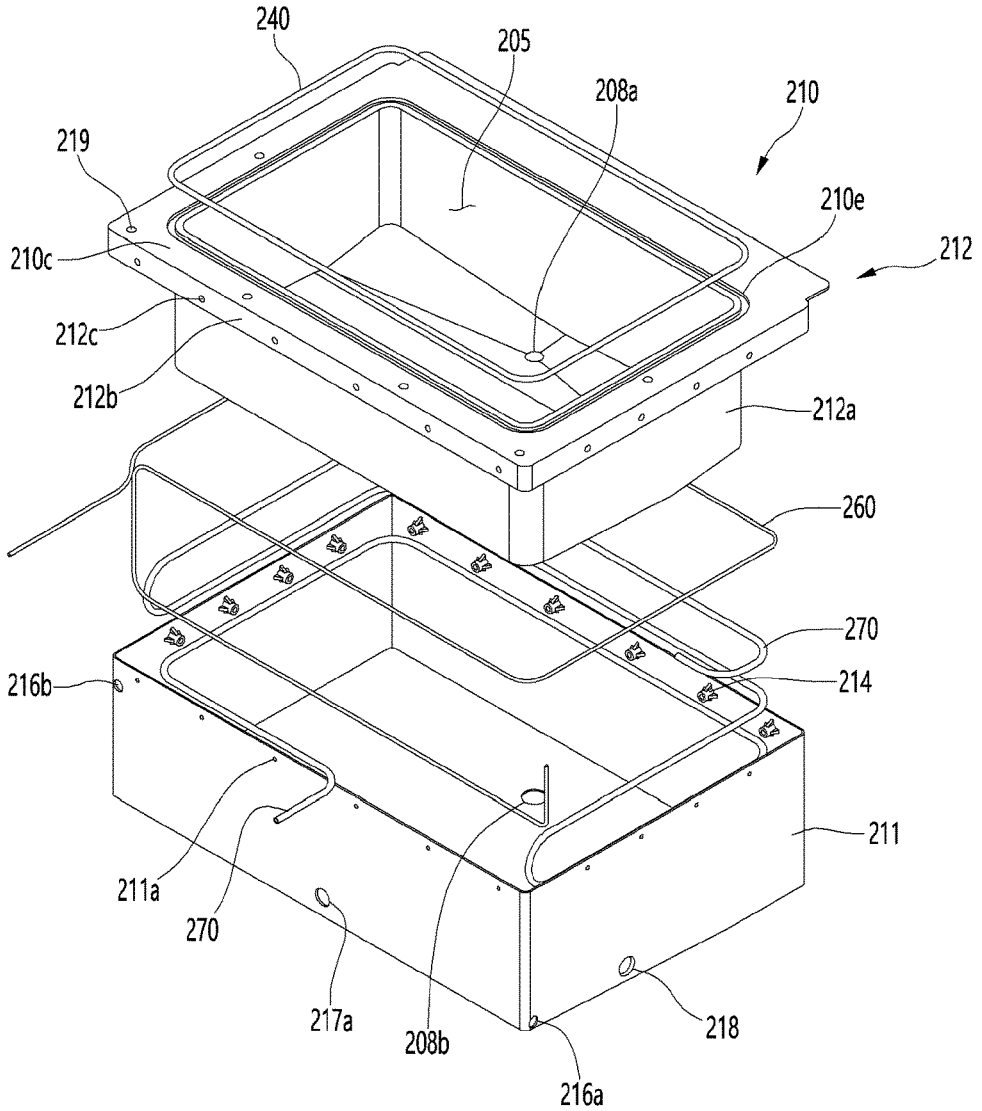
[Fig. 10]
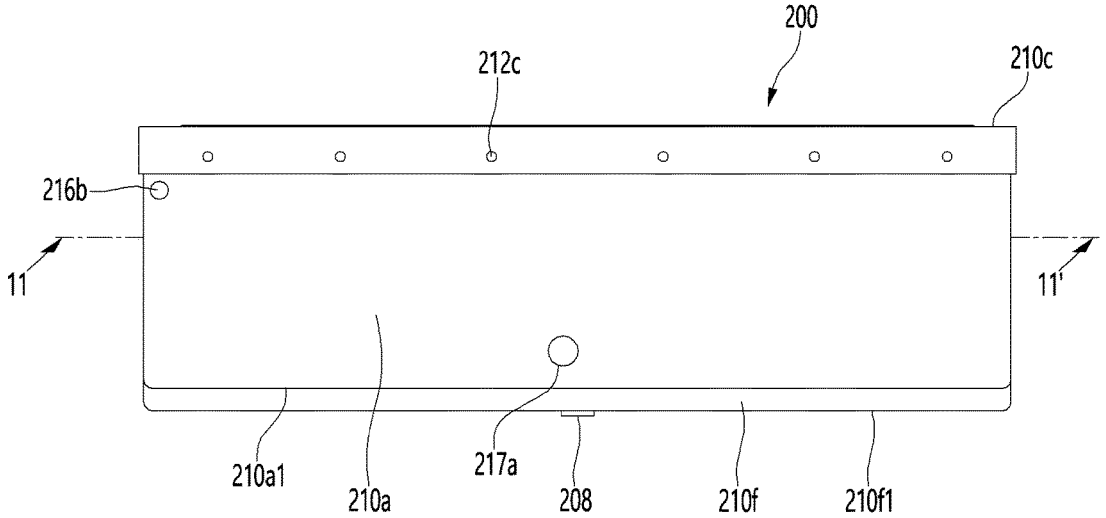

[Fig. 11]
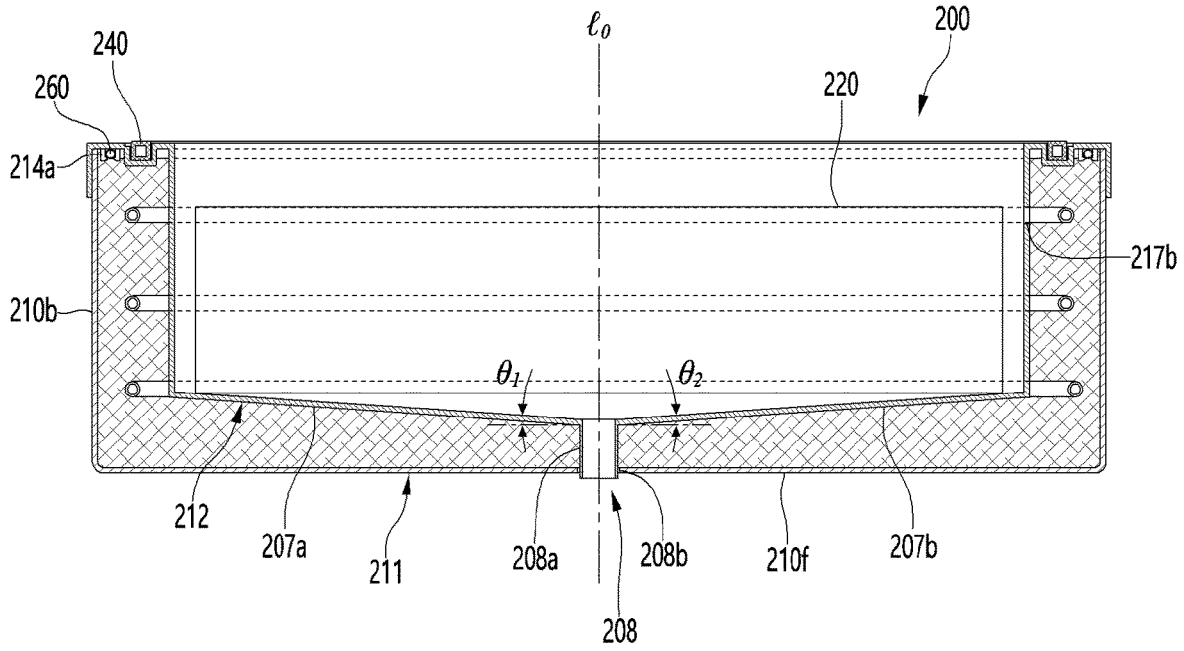
[Fig. 12]
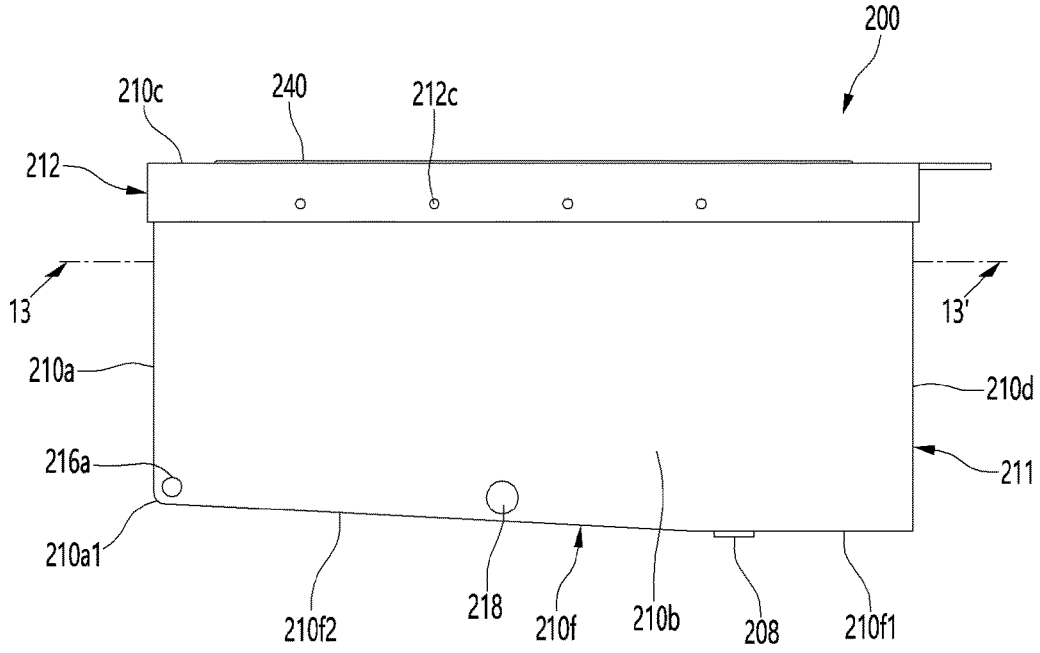

[Fig. 13]
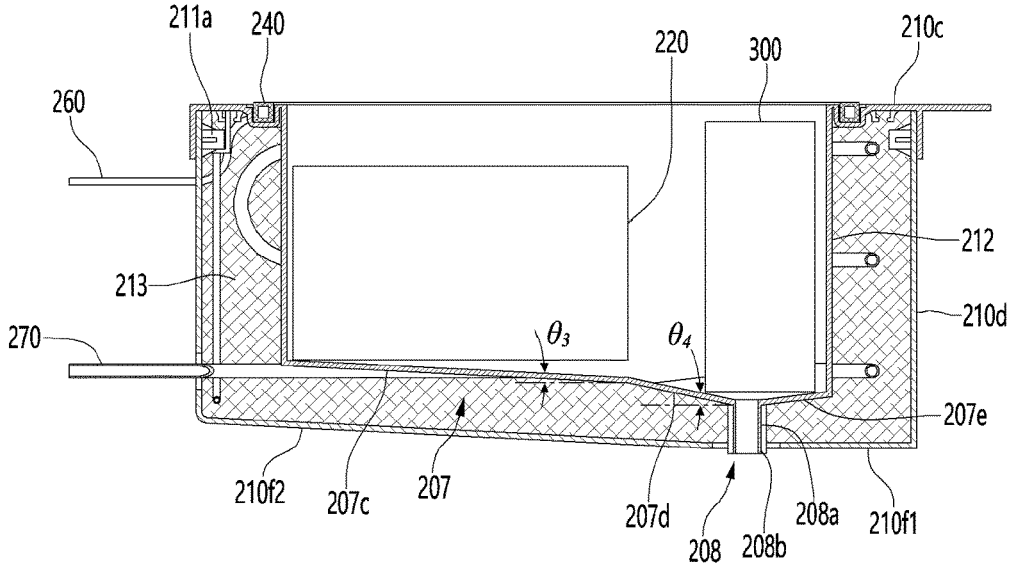
[Fig. 14]
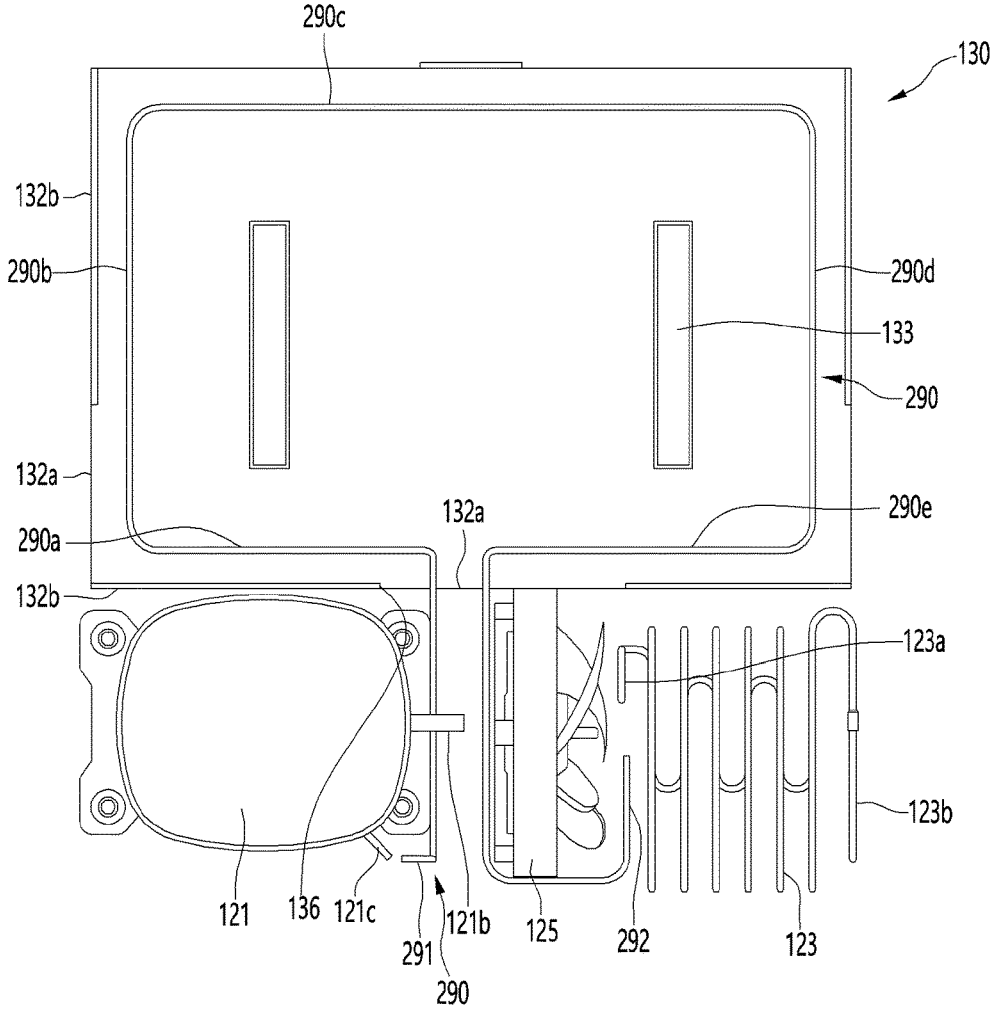

[Fig. 15]
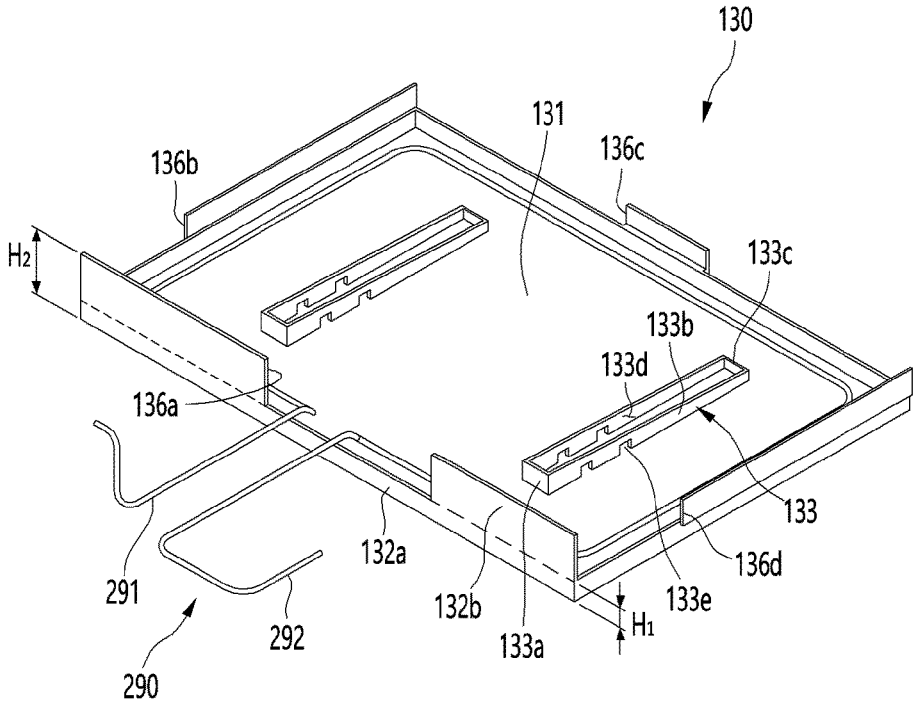
[Fig. 16]
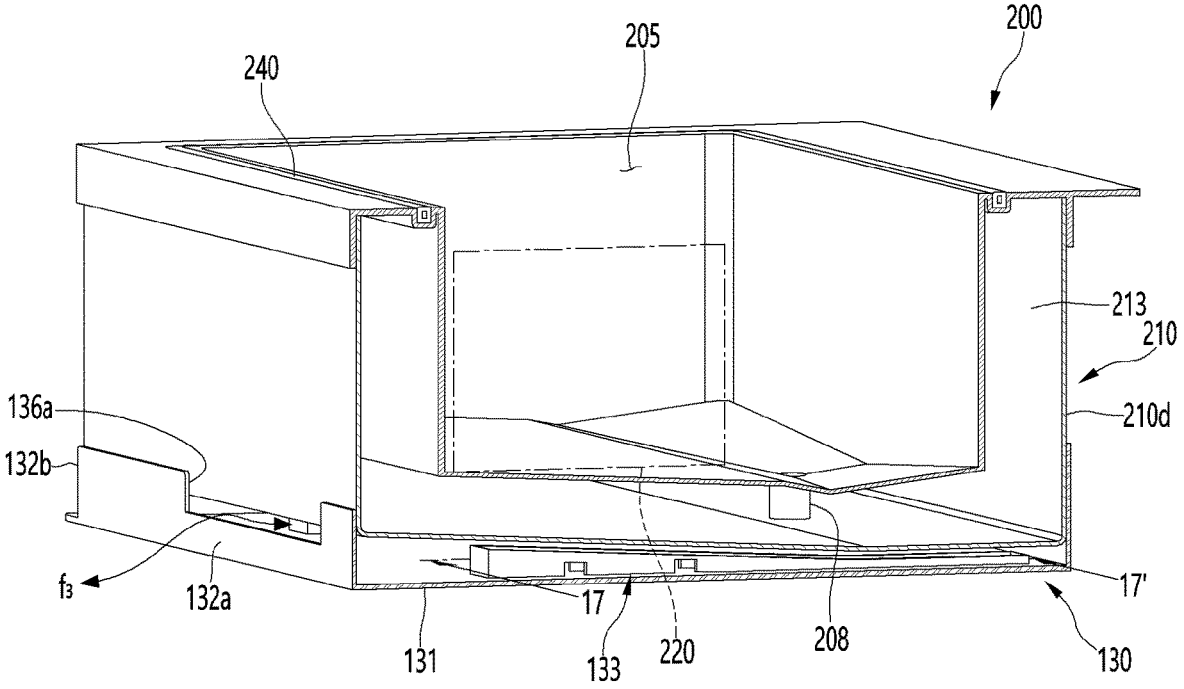

[Fig. 17]
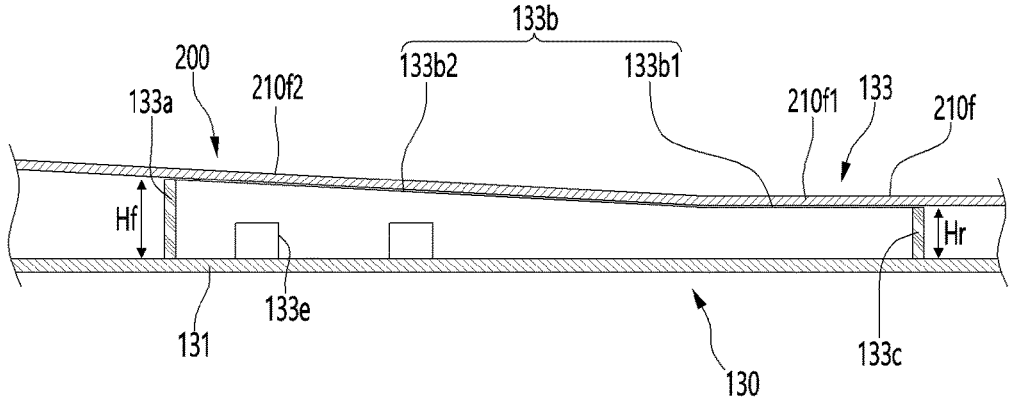
[Fig. 18]
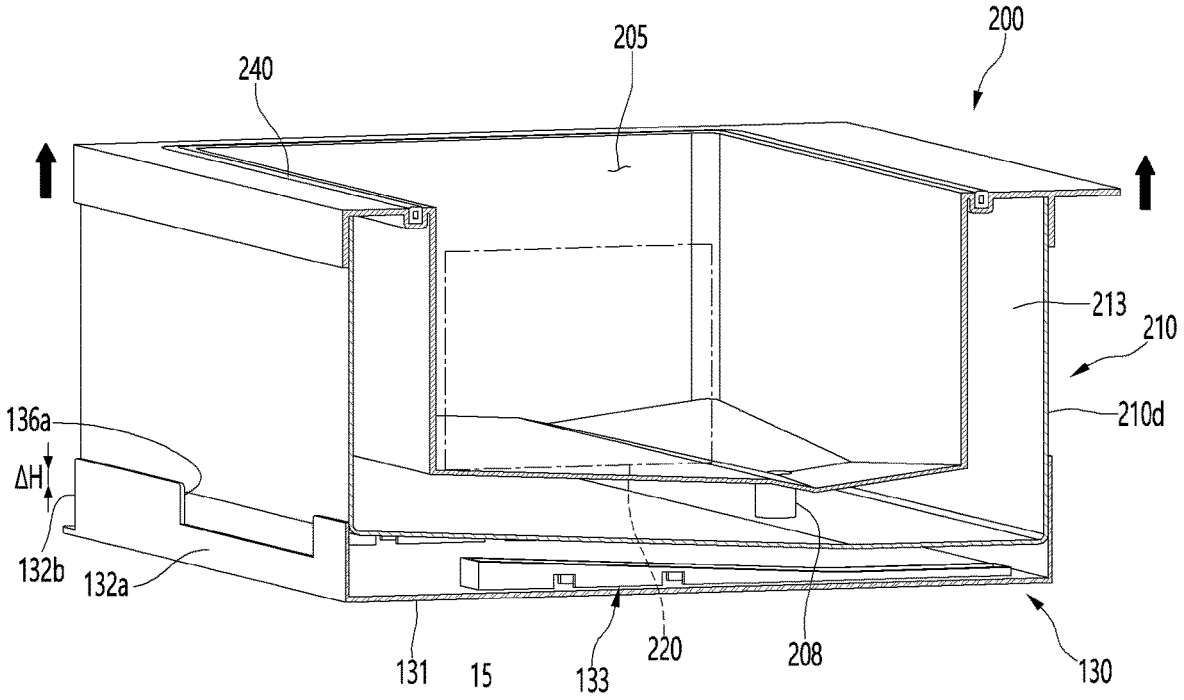

[Fig. 19]
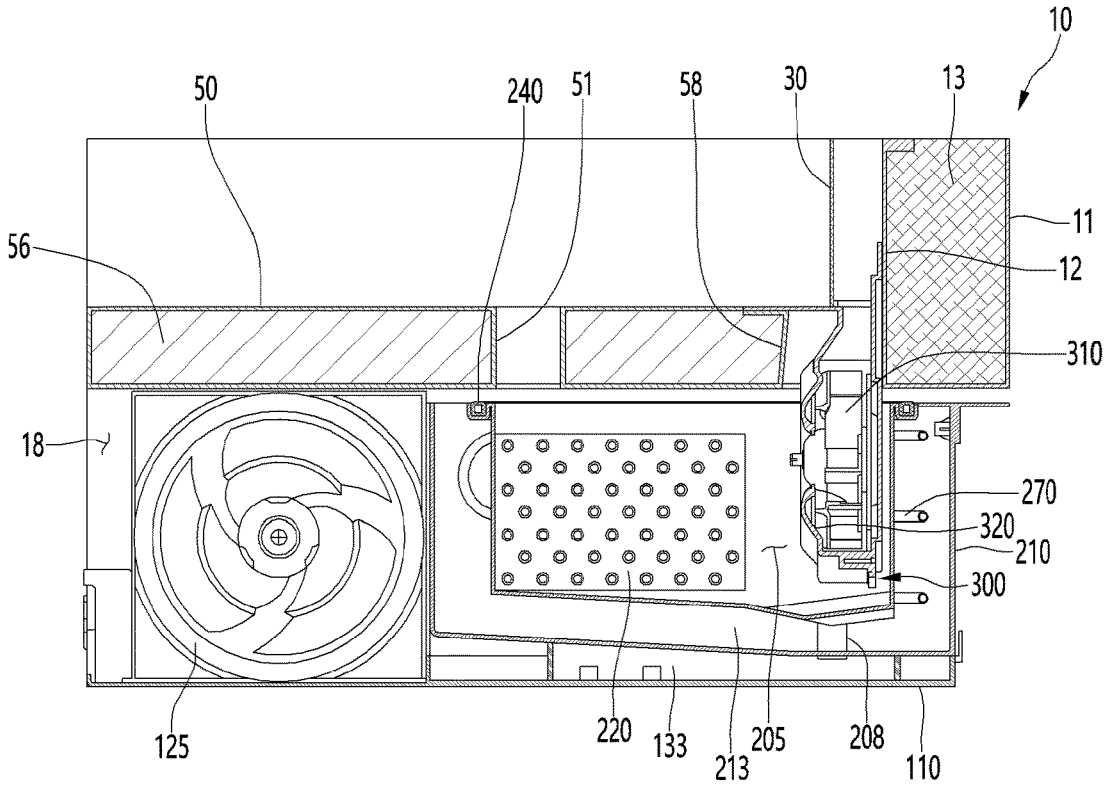
[Fig. 20]
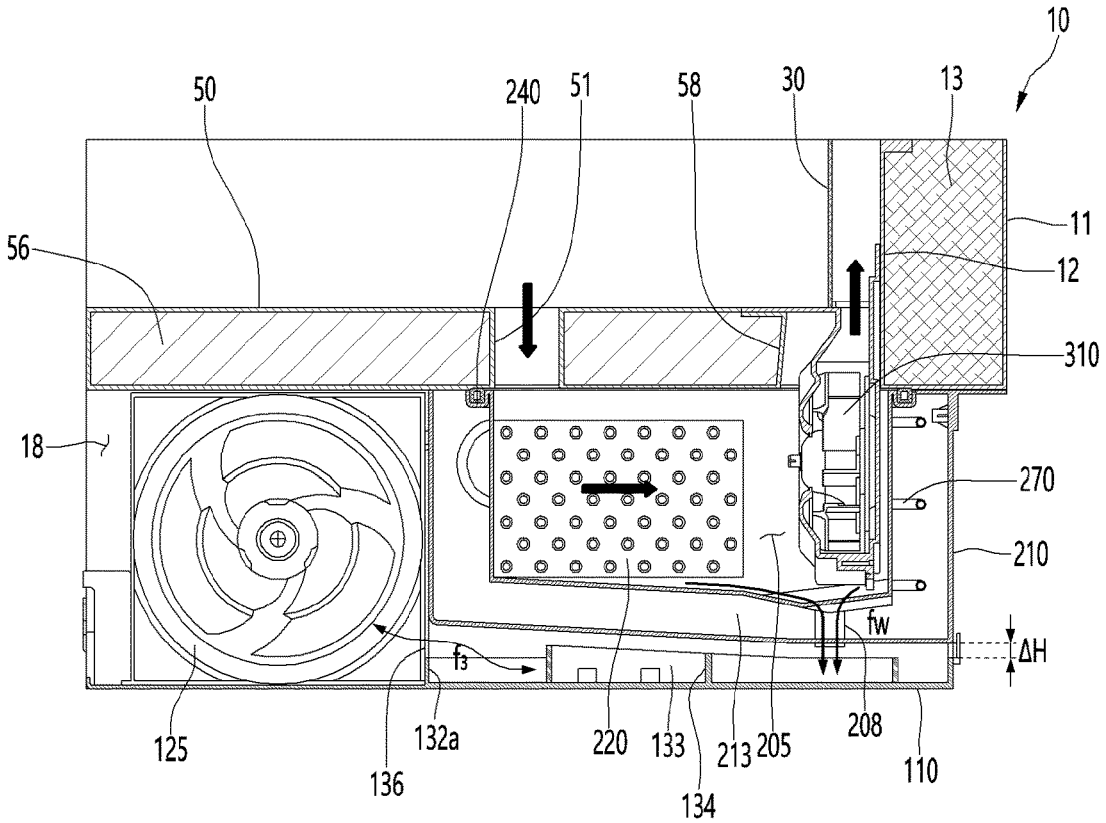

STOREHOUSE

CROSS-REFERENCE TO RELATED PATENT APPLICATIONS

This application is a U.S. National Stage Application under 35 U.S.C. § 371 of PCT Application No. PCT/KR2022/009796, filed Jul. 6, 2022, which claims priority to Korean Patent Application No. 10-2021-0089690, filed Jul. 8, 2021, whose entire disclosures are hereby incorporated by reference.

TECHNICAL FIELD

The present disclosure relates to a storehouse.

BACKGROUND ART

A storehouse may include a storage space for storing goods. Examples of the storehouse may include a refrigerator.

The refrigerator is an apparatus that cools objects to be cooled (e.g., food, drugs, and cosmetics) (hereinafter referred to as food for convenience), or stores food at low temperature so as to prevent spoilage and deterioration. The refrigerator includes a storage space in which food is stored, and a refrigeration cycle part that cools the storage space.

The refrigeration cycle part may include a compressor, a condenser, an expansion mechanism, and an evaporator, through which a refrigerant circulates.

A refrigerator according to the related art may include an outer case, and an inner case located inside the outer case and having an opened front side. Such a refrigerator may include a cold air discharge duct disposed inside the inner case to partition the inside of the inner case into a storage space and a heat exchange space. For example, the storage space may be defined in front of the cold air discharge duct, and the heat exchange space may be defined in the rear of the cold air discharge duct. An evaporator and an evaporating fan may be disposed in the heat exchange space.

The refrigerator may have a separate machine space defined outside the inner case. A compressor, a condenser, and a condensing fan may be disposed in the machine space. The compressor in the machine space may be connected to the evaporator in the heat exchange space through a refrigerant pipe.

The storage space may be provided with a withdrawable drawer. A plurality of the drawers may be provided in a vertical direction.

However, the refrigerator according to the related art as described above has the following problems.

First, the compressor in the machine space and the evaporator in the inner case are disposed in spaces separated from each other and are connected to each other by the refrigerant pipe. Therefore, when it is necessary to repair the refrigeration cycle part, it is inconvenient to take out food stored in the refrigerator so as to check and repair failure.

Second, since the evaporator has to be integrally formed inside the refrigerator body and the evaporator has to be fixed to the refrigerator body by welding or the like, there is an inconvenience in manufacturing the refrigerator. In addition, when the evaporator defrosts, heat exchange with the storage space increases the internal temperature of the refrigerator.

Third, since the heat exchange space is disposed in the rear of the storage space, the width of the rear wall of the refrigerator body in the front-and-rear direction increases as much as the size of the heat exchange space. Therefore, the volume of the storage space is reduced as much.

In order to solve these problems, a refrigerator including a cooling module that integrally configures a heat absorbing portion and a heat dissipating portion has been proposed.

DISCLOSURE

Technical Problem

An embodiment of the present disclosure aims to provide a storehouse in which a first storage space configured to provide a space in which goods are stored is fluidly connected to a second storage space configured to provide a space in which a first heat exchanger is accommodated.

An embodiment of the present disclosure aims to provide a heat exchange device including a tray configured to store a fluid discharged through a drain hole.

An embodiment of the present disclosure aims to provide a heat exchange device capable of increasing an evaporation surface area without reducing a storage volume of a tray.

An embodiment of the present disclosure aims to a storehouse that can reduce a total height of a heat exchanger by reducing a formation height of a tray with respect to a predetermined total height of the storehouse, thereby increasing a capacity of a storage space.

An embodiment of the present disclosure aims to provide a storehouse that provides a support wall on a tray, thereby stably supporting a heat exchanger case and preventing a fluid stored in a tray from coming into contact with a heat exchanger case.

An embodiment of the present disclosure aims to provide a storehouse in which a support wall protrudes from a tray, and when a heat exchanger case is coupled to a storehouse body, a height lifted upward by the support wall is reduced to provide a stable coupling of the heat exchanger case.

An embodiment of the present disclosure aims to provide a storehouse in which a support wall protrudes from an upper surface of a tray, thereby preventing a heat exchanger case from being immersed in a fluid collected in a tray.

An embodiment of the present disclosure aims to provide a storehouse in which a support wall is formed to be inclined downward toward a drain hole of a cooling tray, so that a fluid inside a heat exchanger case can easily flow into a drain hole.

An embodiment of the present disclosure aims to provide a storehouse capable of improving flowability of a fluid collected in a tray by forming a flow hole in a support wall.

An embodiment of the present disclosure aims to provide a storehouse in which a wall protrudes from a tray body, preventing shaking of a heat exchanger case in a front-and-rear direction or a left-and-right direction and guiding the heat exchanger case to be installed in a proper position of a tray.

An embodiment of the present disclosure aims to provide a storehouse in which a pipe through which a high-temperature refrigerant flows for evaporation of a fluid collected in a tray can be disposed.

Technical Solution

The present disclosure may be a storehouse including a first storage space configured to provide a space in which goods are stored within a predetermined temperature or a predetermined temperature range and a second storage space configured to provide a space in which a first heat exchanger is accommodated.

The storehouse may include a third storage space configured to provide a space in which a second heat exchanger is accommodated.

The storehouse may include a first wall defining at least a part of the first storage space.

The storehouse may include a second wall defining at least a part of the second storage space.

The storehouse may include a third wall defining at least a part of the third storage space.

The storehouse may include a heat exchanger case accommodating the first heat exchanger and constituting at least a part of the second wall of the second storage space.

A drain hole is defined in the heat exchanger case, so that the fluid generated in the first heat exchanger or the first fan can be easily discharged.

A tray configured to collect the fluid discharged through the drain hole may be provided below the heat exchanger case.

The tray may include a fluid collecting surface having a size or a shape corresponding to a bottom surface of the heat exchanger case.

The tray may further include a support wall protruding upward from the fluid collecting surface to support a lower side of the heat exchanger case.

The support wall may extend in a front-and-rear direction from a front portion to a rear portion of the tray.

The support wall be formed to be inclined downward toward the rear.

A plurality of support walls may be provided.

The plurality of support walls may be spaced apart from each other in the left-and-right direction.

The support wall may be formed to be inclined downward toward the drain hole of the heat exchanger case so that the fluid inside the heat exchanger case can easily flow to the drain hole.

A flow hole may be formed in the support wall to improve the flowability of the fluid collected in the tray.

The tray may further include a protruding wall to prevent shaking of the heat exchanger case in the front-and-rear direction or in the left-and-right direction and to allow the heat exchanger case to be installed in the proper position of the tray.

The wall may be disposed at the edge of the tray.

A plurality of walls may be provided.

The tray may include a front portion, two side portions, and a rear portion, and the wall may be provided on at least one of the front portion, the two side portions, and the rear portion.

The wall may include a front wall provided on the front portion.

The wall may further include side walls provided on the two side portions.

The wall may further include a rear wall provided on the rear portion.

A pipe through which a refrigerant flows may be disposed in the tray to facilitate evaporation of the collected fluid.

The pipe may be disposed above the fluid collecting surface of the tray.

The pipe may include a discharge pipe of a compressor.

The pipe may include an outlet pipe of a condenser.

In one aspect of the present disclosure, a storehouse may include a first storage space configured to provide a space in which goods are stored within a predetermined temperature or a predetermined temperature range and a second storage space configured to provide a space in which a first heat exchanger is accommodated.

The storehouse may include a third storage space configured to provide a space in which a second heat exchanger is accommodated.

The storehouse may include a first wall defining at least a part of the first storage space, a second wall defining at least a part of the second storage space, and a third wall defining at least a part of the third storage space.

The storehouse may include a tray provided adjacent to the second wall defining at least a part of the second storage space and forming a fluid collecting portion configured to store a fluid discharged from the second wall.

The second storage space may be fluidly connected to the first storage space.

The second wall may include a discharge passage through which a fluid is discharged, and the tray may include a tray body having one surface facing the discharge passage.

The tray may include a support wall protruding from the tray body, and the second wall may be spaced upward apart from the support wall and is fixed to the first wall.

The support wall may include an opened end portion that faces the second wall.

A fluid collecting space may be formed inside the support wall.

The support wall may include a support front portion, two support side portions extending from both sides of the support front portion, and a support rear portion connecting the two support side portions, and the support front portion, the two support side portions, and the support rear portion may define the fluid collection space.

At least one of the first wall and the second wall may define a device accommodation space configured to accommodate the first heat exchanger, and the support wall may extend long in a first direction in which the first heat exchanger is mounted.

The first direction may be a direction toward the rear of the first storage space, and the support wall may include a support side portion extending obliquely downward toward the rear.

One surface of the second wall may be formed to be inclined to correspond to a shape of the support side portion.

The support wall may form a flow hole so that the fluid stored in the tray is introduced into the fluid collecting space.

The support wall may include a support front portion, two support side portions extending from both sides of the support front portion, and a support rear portion connecting the two support side portions, and the flow hole may be formed in the support side portion.

The tray may include a tray body, and a storage wall forming an edge of the tray body and protruding from the tray body, and the tray body and the storage wall may define the fluid collecting portion.

The storage wall may include a first portion having a first height and a second portion having a second height greater than the first height, and the second portion may include a portion configured to restrict movement of the second wall in at least one direction.

The storehouse may further include a heat source disposed in the fluid collecting portion of the tray.

The heat source may include a refrigerant pipe.

The refrigerant pipe may include a discharge pipe of a compressor.

The refrigerant pipe may include a discharge pipe of a condenser.

The second wall may include a heat exchanger case configured to accommodate the first heat exchanger.

The heat exchanger case may include one surface forming an opening, and the one surface of the heat exchanger case may be in contact with the first wall.

Advantageous Effects

According to an embodiment of the present disclosure, first and second storage spaces are fluidly connected to each other. Therefore, the fluid heat-exchanged in a first heat exchanger may be easily supplied to the first storage space, and the fluid in the first storage space may be easily returned to the second storage space.

According to an embodiment of the present disclosure, a first fan is installed inside a heat exchanger case, so that a flow through the first heat exchanger can be easily generated.

According to an embodiment of the present disclosure, a drain hole is formed in the heat exchanger case, so that the fluid generated in the first heat exchanger or the first fan can be easily discharged.

According to an embodiment of the present disclosure, the fluid discharged through the drain hole may be easily stored by the tray.

According to an embodiment of the present disclosure, due to the improved structure of the tray, the evaporation surface area can be increased without reducing the storage volume of the tray.

According to an embodiment of the present disclosure, the total height of the heat exchanger can be reduced by reducing the formation height of the tray with respect to a predetermined total height of the storehouse, thereby increasing the capacity of the storage space.

According to an embodiment of the present disclosure, by providing a support wall on the tray, it is possible to stably support the heat exchanger case and to prevent the fluid stored in the tray from coming into contact with the heat exchanger case.

According to an embodiment of the present disclosure, the support wall protrudes from the tray, and when the heat exchanger case is coupled to the storehouse body, the height lifted upward by the support wall is reduced to provide a stable coupling of the heat exchanger case.

According to an embodiment of the present disclosure, by providing the support wall protruding from the upper surface of the tray, it is possible to prevent the heat exchanger case from being immersed in the fluid collected in the tray.

According to an embodiment of the present disclosure, the support wall is formed to be inclined downward toward the drain hole of the cooling tray, so that the fluid inside the heat exchanger case can easily flow into the drain hole.

According to an embodiment of the present disclosure, the flowability of the fluid collected in the tray can be improved by forming a flow hole in the support wall.

According to an embodiment of the present disclosure, a wall protruding from the tray body may be provided to prevent shaking of the heat exchanger case in the front-and-rear direction or the left-and-right direction and guide the heat exchanger case to be installed in the proper position of the tray.

According to an embodiment of the present disclosure, a pipe through which a high-temperature refrigerant flows for evaporation of the fluid collected in the tray may be disposed.

DESCRIPTION OF DRAWINGS

FIG. 1 is a schematic diagram of a storehouse according to an embodiment of the present disclosure.

FIG. 2 is a front perspective view of the storehouse according to an embodiment of the present disclosure.

FIG. 3 is an exploded perspective view of a storehouse body and a heat exchange device according to an embodiment of the present disclosure.

FIG. 4 is a perspective view of the heat exchange device according to an embodiment of the present disclosure.

FIG. 5 is an exploded perspective view of the heat exchange device according to an embodiment of the present disclosure.

FIG. 6 is a plan view of a partial configuration of the heat exchange device according to an embodiment of the present disclosure.

FIG. 7 is a cross-sectional view taken along line 7-7' of FIG. 6.

FIG. 8 is a perspective view showing a configuration of a heat exchanger case according to an embodiment of the present disclosure.

FIG. 9 is an exploded perspective view of the heat exchanger case according to an embodiment of the present disclosure.

FIG. 10 is a front view of the heat exchanger case according to an embodiment of the present disclosure.

FIG. 11 is a cross-sectional view taken along line 11-11' of FIG. 10.

FIG. 12 is a side view of the heat exchanger case according to an embodiment of the present disclosure.

FIG. 13 is a cross-sectional view taken along line 13-13' of FIG. 12.

FIG. 14 is a plan view showing a state in which a compressor, a second heat exchanger, and a tray pipe are connected, according to an embodiment of the present disclosure.

FIG. 15 is a view showing a state in which the tray pipe is installed in a tray, according to an embodiment of the present disclosure.

FIG. 16 is a cross-sectional view showing a state in which a heat exchanger case is seated on the upper side of the tray, according to the embodiment of the present disclosure.

FIG. 17 is a cross-sectional view taken along line 17-17' of FIG. 16.

FIG. 18 is a cross-sectional view showing a state in which the heat exchanger case is moved upward, according to the embodiment of the present disclosure.

FIG. 19 is a cross-sectional view showing a state in which the heat exchange device is disposed in a device accommodation space, according to an embodiment of the present disclosure.

FIG. 20 is a cross-sectional view showing a state in which the heat exchanger case is in contact with a partition wall, according to an embodiment of the present disclosure.

MODE FOR INVENTION

The present disclosure may be a storehouse including a first storage space configured to provide a space in which goods are stored within a predetermined temperature or a predetermined temperature range and a second storage space configured to provide a space in which a first heat exchanger is accommodated.

Examples of the storehouse may be a refrigerator, a heating cabinet, and the like.

Examples of the goods may include food, medical products, and the like.

The storehouse may include a third storage space configured to provide a space in which a second heat exchanger is accommodated.

The storehouse may include a first wall defining at least a part of the first storage space.

The storehouse may include a second wall defining at least a part of the second storage space.

The storehouse may include a third wall defining at least a part of the third storage space.

The second storage space may be fluidly connected to the first storage space.

The first heat exchanger may be a heat exchanger that is fluidly connected to an inner space of the first storage space to exchange heat with a fluid present in the inner space.

The second heat exchanger may be a heat exchanger that is fluidly connected to an outer space of the first storage space to exchange heat with a fluid present in the outer space.

Examples of a heat exchange method of the heat exchanger may include direct heat exchange by conduction or indirect heat exchange by convection or radiation.

An example of the heat exchanger may be a heat absorbing portion, a cooling power generator, and a heat exchanger provided as a cold source. An example of the cold source may be an evaporator, a heat absorbing surface of a thermoelectric element as a heat absorbing portion of a thermoelectric module, or a cold sink connected to the heat absorbing surface.

Another example of the heat exchanger may be a heat dissipating portion, a heat power generator, and a heat exchanger provided as a heat source. Examples of the heat source may be a condenser, a heat generating surface of a thermoelectric element as a heat dissipating portion of a thermoelectric module, or a heat sink connected to the heat generating surface. Examples of the fluid may include a liquid or a gas, such as air, water, and a refrigerant.

The first wall may be provided to separate the inner space of the first storage space from the outer space of the first storage space.

The second wall may be provided to separate the inner space of the second storage space from the outer space of the second storage space.

The third wall may be provided to separate the inner space of the third storage space from the outer space of the third storage space.

The first wall may be provided to separate the first storage space from at least one of the second storage space and the third storage space.

The second wall may be provided to separate the second storage space from at least one of the first storage space and the third storage space.

The third wall may be provided to separate the third storage space from at least one of the first storage space and the second storage space.

The wall provided to separate the first storage space from the second storage space may be provided as a common wall between the first wall and the second wall.

The wall provided to separate the second storage space from the third storage space may be provided as a common wall between the second wall and the third wall.

The wall provided to separate the first storage space from the third storage space may be provided as a common wall between the first wall and the third wall.

The wall may be provided as one wall including a plurality of layers. A plurality of walls may be connected in a longitudinal direction and provided as one wall.

Fluidly connecting the first space and the second space may be defined as follows: the fluid located in one of the first space and the second space is movable to the other one of the first space and the second space.

The storehouse may include a door provided to open or close the first storage space. The door may be provided to cover at least a part of the second storage space. The door may be provided to cover at least a part of the third storage space.

In the present disclosure, when an object is divided into three equal portions based on the longitudinal direction of the object, the central portion of the object may be defined as the position located in the center among the three equally-divided portions. The peripheral portion of the object may be defined as a portion located to the left or right of the central portion among the three equally-divided portions. The peripheral portion of the object may include a surface in contact with the central portion and a surface opposite thereto. The opposite surface may be defined as a border or an edge of the object.

The storehouse may include a fluid generator disposed on a path through which the fluid flows so that the fluid in the inner space of the storage space flows to the outer space of the storage space.

The fluid generator may include a fluid generator for the second storage space disposed on a path through which the fluid flows so that the fluid in the second storage space flows to the outer space of the second storage space.

The fluid generator may include a fluid generator for the third storage space disposed on a path through which the fluid flows so that the fluid in the third storage space flows to the outer space of the third storage space.

Examples of the fluid generator may include a fan allowing air to flow, a pump allowing water to flow, a compressor allowing a refrigerant to flow, and the like.

A first passage, through which the fluid flows, may be provided inside of the first wall or in the vicinity of the first wall.

Examples of the first passage may be a through hole defined to pass through the inside of the wall, a duct provided inside the wall, or a duct provided outside the wall.

The first passage may include an inlet passage configured to guide the fluid in the outer space of the first storage space to flow to the inner space of the first storage space.

The first passage may include an outlet passage configured to guide the fluid in the inner space of the first storage space to flow to the outer space of the first storage space.

The first passage may include an inlet passage configured to guide the fluid heat-exchanged in the outer space of the first storage space to flow to the inside of the first storage space.

The first passage may include an outlet passage configured to guide the fluid heat-exchanged with goods in the inner space of the first storage space to flow to the outer space of the first storage space.

The inlet passage may be provided in at least one of a front wall, a rear wall, a side wall, an upper wall, and a lower wall of the first storage space.

The outlet passage may be provided in at least one of the front wall, the rear wall, the side wall, the upper wall, and the lower wall of the first storage space.

For example, the inlet passage may be provided as a through hole or a duct disposed in the rear wall of the first storage space.

For example, the outlet passage may be provided as a through hole or a duct disposed in the lower wall of the first storage space.

A second passage, through which the fluid flows, may be provided inside of the second wall or in the vicinity of the second wall.

Examples of the second passage may be a through hole defined to pass through the inside of the wall, a duct provided inside the wall, or a duct provided outside the wall.

The second passage may include an inlet passage configured to guide the fluid in the outer space of the second storage space to flow to the inner space of the second storage space.

The second passage may include an outlet passage configured to guide the fluid in the inner space of the second storage space to flow to the outer space of the second storage space.

The second passage may include an inlet passage configured to guide the fluid heat-exchanged in the outer space of the second storage space to flow to the inside of the second storage space.

The second passage may include an outlet passage configured to guide the fluid heat-exchanged with the first heat exchanger to flow to the outer space of the second storage space.

The inlet passage may be provided in at least one of a front wall, a rear wall, a side wall, an upper wall, and a lower wall of the second storage space.

For example, the inlet passage may be provided as a through hole or a duct disposed in the upper wall of the second storage space.

For example, the outlet passage may be provided as a through hole or a duct disposed in the upper wall of the second storage space.

A third passage, through which the fluid flows, may be provided inside of the third wall or in the vicinity of the third wall.

Examples of the third passage may be a through hole defined to pass through the inside of the wall, a duct provided inside the wall, or a duct provided outside the wall.

The third passage may include an inlet passage configured to guide the fluid in the outer space of the third storage space to flow to the inner space of the third storage space.

The third passage may include an outlet passage configured to guide the fluid in the inner space of the third storage space to flow to the outer space of the third storage space.

The third passage may include an inlet passage configured to guide the fluid heat-exchanged in the outer space of the third storage space to flow to the inside of the third storage space.

The third passage may include an outlet passage configured to guide the fluid heat-exchanged with the second heat exchanger to flow to the outer space of the third storage space.

The inlet passage may be provided in at least one of a front wall, a rear wall, a side wall, an upper wall, and a lower wall of the third storage space.

The outlet passage may be provided in at least one of the front wall, the rear wall, the side wall, the upper wall, and the lower wall of the third storage space.

For example, the inlet passage may be provided as a through hole or a duct disposed in the front wall of the third storage space.

For example, the outlet passage may be provided as a through hole or a duct disposed in the front wall of the third storage space.

The fluid in the inner space of the first storage space may be fluidly connected to one of the second storage space and the third storage space.

For example, the fluid in the inner space of the first storage space may flow to the inner space of the second storage space via the second passage.

The fluid in the inner space of the second storage space may flow to the inner space of the first storage space via the first passage.

The fluid in the outer space of the storehouse may be fluidly connected to one of the second storage space and the third storage space.

For example, the fluid in the inner space of the third storage space may flow to the outer space of the third storage space via the third passage.

The fluid in the outer space of the third storage space may flow to the inner space of the third storage space via the third passage.

The second storage space may be disposed in the outer space of the first storage space together with the third storage space.

At least a part of the second wall may be coupled to at least a part of the third wall and then disposed in the outer space of the first storage space.

At least a part of the second wall may be integrally provided with at least a part of the third wall and then disposed in the outer space of the first storage space.

At least a part of the second wall may extend so as to be provided as at least a part of the third wall.

At least a part of the third wall may extend so as to be provided as at least a part of the second wall.

At least a part of the second wall may extend to support at least a part of the third wall.

At least a part of the third wall may extend to support at least a part of the second wall.

The portion from which the second wall extends may be provided on at least one of the front wall, the rear wall, the side wall, the upper wall, and the rear wall of the second storage space.

The portion from which the third wall extends may be provided on at least one of the front wall, the rear wall, the side wall, the upper wall, and the rear wall of the third storage space.

For example, the portion from which the second wall extends may be provided on the lower wall of the second storage space.

As another example, the portion from which the third wall extends may be provided on the lower wall of the third storage space.

The first heat exchanger acting as a cold source may be provided in the second storage space.

A heat source that removes frost generated in the first heat exchanger may be disposed in the vicinity of the first heat exchanger.

For example, the heat source may be a defrosting heat source.

The first heat exchanger acting as a heat source may be provided in the second storage space.

A cold source that removes steam generated in the first heat exchanger may be disposed in the vicinity of the first heat exchanger.

For example, the cold source may be a steam removing cold source.

The second wall may include a through hole through which the second storage space is fluidly connected to the first storage space.

The second wall may include a portion having a higher degree of insulation than the third wall.

The second wall may be a wall that partitions the first storage space and the second storage space.

In this manner, it is possible to reduce the transfer of the heat of the defrosting heat source or the cold of the steam removing cold source to the first storage space or the outer space of the second storage space.

The second wall may include a through hole through which the second storage space is fluidly connected to the first passage.

The second wall may include a portion having a higher degree of insulation than the wall defining the first passage. In this manner, it is possible to reduce the transfer of the heat of the defrosting heat source or the cold of the steam removing cold source to the first storage space or the outer space of the second storage space.

The first storage space may include a plurality of storage compartments. The first storage space may include at least one of a partition wall, a drawer, and a shelf so as to form the plurality of storage compartments. A passage through which a fluid flows may be provided between the plurality of storage compartments.

An embodiment capable of reducing heat exchange between the defrosting heat source or the steam removing cold source and some of the plurality of storage compartments is as follows. In this manner, when the storehouse is provided as a refrigerator, cooling efficiency may be improved, and when the storehouse is provided as a heating cabinet, heating efficiency may be improved.

First, one of the plurality of storage compartments may include a surface that faces the second storage space and a surface that faces another one of the plurality of storage compartments.

One of the plurality of storage compartments may be disposed between the second storage space and another one of the plurality of storage compartments. In this case, one of the plurality of storage compartments may be provided as an insulating space for reducing heat transfer between another one of the plurality of storage compartments and the defrosting heat source or the steam removing cold source.

Second, one of the plurality of storage compartments may include both the through hole through which the fluid flows into the second storage space and the through hole through which the fluid flows out from the second storage space, and another one of the plurality of storage compartments may include only one of the through hole through which the fluid flows into the second storage space and the through hole through which the fluid flows out from the second storage space.

For example, the through hole of one of the plurality of storage compartments may be provided inside of the second wall or in the vicinity of the second wall. The through hole of another one of the plurality of storage compartments may be provided inside of the first wall or in the vicinity of the first wall.

Third, only one of the plurality of storage compartments may be disposed to face the second storage space or may be disposed adjacent to the second storage space. For example, one of the plurality of storage compartments may be provided in at least one of the uppermost end, the lowermost end, the rightmost end, the leftmost end, the rearmost end, and the foremost end of the second storage space.

Fourth, the fluid inside the first storage compartment among the plurality of storage compartments may be provided to flow into the second storage space without passing through another one of the plurality of storage compartments, and the fluid inside the second storage compartment among the plurality of storage compartments may be provided to flow into the second storage space through another one of the plurality of storage compartments.

An embodiment in which the second storage space and the third storage space are disposed is as follows.

First, the first storage space may include a portion extending in a horizontal direction, i.e., X-axis direction, and a portion extending in a vertical direction, i.e., Y-axis direction. The second storage space may be disposed adjacent to the third storage space in the X-axis direction. A wall partitioning the second storage space and the third storage space may include a portion extending in the Y-axis direction.

Second, the first storage space may include a portion extending in a horizontal direction, i.e., X-axis direction, and a portion extending in a vertical direction, i.e., Y-axis direction. The second storage space may be disposed adjacent to the third storage space in the Y-axis direction. A wall partitioning the second storage space and the third storage space may include a portion extending in the X-axis direction.

An embodiment in which the first heat exchanger and the fluid generator are disposed is as follows.

First, the first heat exchanger may include a long portion extending in the X-axis direction and a short portion extending in the Y-axis direction, and the fluid generator may be disposed such that a length in the X-axis direction is longer than a length in the Y-axis direction.

The fluid generator may be disposed spaced apart from the first heat exchanger in the Y-axis direction.

For example, the fluid generator may be disposed above or below the first heat exchanger.

The fluid generator may be disposed to overlap the first heat exchanger in the Y-axis direction. The fluid generator may be disposed in an inclined direction with respect to the ground.

A suction hole through which the fluid is sucked into the first heat exchanger may be disposed to be lower than a discharge hole through which the fluid heat-exchanged with the first heat exchanger is discharged.

In this manner, the effect of reducing the flow loss of the fluid generator may be obtained.

Second, the first heat exchanger may include a long portion extending in the X-axis direction and a short portion extending in the Y-axis direction, and the fluid generator may be disposed such that a length in the X-axis direction is shorter than a length in the Y-axis direction.

The fluid generator may be disposed spaced apart from the first heat exchanger in the X-axis direction. For example, the fluid generator may be disposed in the front or rear of the first heat exchanger. The fluid generator may be disposed to overlap the first heat exchanger in the X-axis direction.

The storehouse may include a fluid generator for the second storage space. An embodiment of the arrangement of the fluid generator is as follows.

First, an imaginary line extending from the center of the fluid generator toward the first heat exchanger may be disposed to pass through the first heat exchanger. The center of the fluid generator may be defined as at least one of the center of gravity, the center of mass, the center of volume, and the center of rotation of the fluid generator. The imaginary line may be disposed to pass through the central portion of the first heat exchanger. The imaginary line may be disposed to pass through the peripheral portion of the first heat exchanger.

Second, an imaginary line extending from the center of the fluid generator toward the first storage space may be disposed to pass through the first storage space. An imaginary line extending from the center of the fluid generator toward the first heat exchanger may be disposed so as not to overlap the first heat exchanger.

Third, the fluid generator may be disposed inside the second storage space. In this case, the first heat exchanger and the fluid generator may be disposed inside the second storage space, which may be advantageous in designing a module for the second storage space. At least a part of the second passage may be provided to be exposed to the second storage space.

Fourth, the fluid generator may be disposed in at least one of the inside of the first passage and the inside of the second passage. In this case, since the distance between the first heat exchanger and the fluid generator may be separated, there is an advantage that can reduce a dead zone that may occur in the flow passage of the fluid. The passage on which the fluid generator is disposed may include a portion protruding toward the first storage space. Therefore, the volume of the first storage space may be increased. The fluid generator may be disposed inside the protruding portion.

Fifth, at least a part of the fluid generator may be provided to form at least a part of the first passage or at least a part of the second passage. For example, the fluid generator may include a fan and a fan housing. The fan housing may define at least a part of the first passage, or the fan housing may define at least a part of the second passage.

Hereinafter, some embodiments of the present disclosure will be described in detail with reference to exemplary drawings. In assigning reference numerals to the components of the drawings, it should be noted that the same components are denoted by the same reference numerals as much as possible even though the components are shown in different drawings. In addition, in describing the embodiments of the present disclosure, if the detailed description of the relevant known functions or configurations is determined to unnecessarily obscure the gist of the present disclosure, the detailed description thereof is omitted.

In addition, the terms, such as "first", "second", "A", "B", "(a)", or "(b)" may be used herein to describe the components of the present disclosure. These terms are only for distinguishing one component from another, and the essence, order, or sequence of the components is not limited by the terms. When one component is described as being "connected", "coupled", or "linked" to another component, the component may be directly connected or coupled to the other component, but it should be understood that another component may be "connected", "coupled" or "linked" between components.

FIG. 1 is a schematic diagram of a storehouse according to an embodiment of the present disclosure.

Referring to FIG. 1, a storehouse 1 according to an embodiment of the present disclosure includes a storehouse body 10 defining a first storage space 15.

The storehouse may be configured as a refrigerator or a heating cabinet.

The first storage space 15 may provide a space in which goods are stored within a predetermined temperature or a predetermined temperature range.

The storehouse 1 may include a first wall defining at least a part of the first storage space 15.

The first wall may include at least one of a front wall, a rear wall, a side wall, an upper wall, and a lower wall.

The first wall may include a plurality of walls.

For example, the storehouse body 10 may have a hexahedral shape with an opened front side. However, the shape of the storehouse body 10 is not limited thereto.

The storehouse body 10 may include a body outer case 11 (referring to FIG. 3), a body inner case 12 (referring to FIG. 3) assembled inside the body outer case 11, and a body insulating material 13 (referring to FIG. 3) for insulation provided between the body outer case 11 and the body inner case 12.

The storehouse 1 may further include a door 20 capable of opening or closing the first storage space 15. The door 20 may be movably provided in front of the storehouse body 10.

A shelf 23 on which food is supported may be provided in the first storage space 15. For example, a plurality of shelves 23 may be vertically spaced apart from each other in the first storage space 15.

A drawer 22 that accommodates food may be provided in the first storage space 15. The drawer 22 is provided to be withdrawable. The drawer 22 may be provided in plurality. For example, the plurality of drawers 22 may be vertically spaced apart from each other in the first storage space 15.

A plurality of storage compartments may be defined by the plurality of shelves 23 or the plurality of drawers 22.

A duct 30 for supplying a fluid to the first storage space 15 may be provided on the rear wall of the first storage space 15.

The duct 30 may constitute a first passage through which the fluid flows, the first passage being provided inside of the first wall or in the vicinity of the first wall defining the first storage space 15.

The duct 30 may be located behind the plurality of drawers 22.

The fluid heat-exchanged in a second storage space 16 flows through the duct 30, and a duct discharge hole 35 through which the fluid is discharged to the first storage space 15 may be defined on the front surface of the duct 30.

A plurality of duct discharge holes 35 may be defined. The plurality of duct discharge holes 35 may be disposed vertically.

The duct 30 extends in the vertical direction and is configured to have a constant width w in the front-and-rear direction. Due to the duct 30 having a constant width, the plurality of drawers 22 may be disposed vertically with the same size and shape.

The storehouse 1 may include the second storage space 16 providing a space in which a first heat exchanger E1 is accommodated.

The second storage space 16 may be partitioned from the first storage space 15 by a partition wall B1.

The partition wall B1 may constitute at least a part of the first storage space 15.

The partition wall B1 may constitute at least a part of the second storage space 16.

The partition wall B1 may constitute at least a part of the third storage space 17.

The storehouse 1 may include a third storage space 17 providing a space in which a second heat exchanger E2 is accommodated.

The first heat exchanger E1 and the second heat exchanger E2 may be separated by an insulating wall B2.

The insulating wall B2 may constitute at least a part of the second storage space 16.

The insulating wall B2 may constitute at least a part of the third storage space 17.

The storehouse 1 may include a heat exchange device 100. The heat exchange device 100 includes the first heat exchanger E1 and the second heat exchanger E2.

For example, the heat exchange device 100 may be detachably disposed at the lower portion of the storehouse body 10. However, the present disclosure is not limited thereto, and the first heat exchanger E1 and the second heat exchanger E2 may be provided separately from each other.

The second heat exchanger E2 may be disposed in the front portion of the heat exchange device 100, and the first heat exchanger E1 may be disposed in the rear portion of the heat exchange device 100.

The insulating wall B2 may be located between the first heat exchanger E1 and the second heat exchanger E2.

Two independent flows may be generated in the heat exchange device 100. The two independent flows may include a first flow f1 circulating through the first and second storage spaces 15 and 16 and a second flow f2 passing through the inside and the outside of the third storage space 17.

The heat exchange device 100 may further include a cover B3 through which the second flow f2 passes.

The cover B3 may define at least a part of the third storage space 17.

The cover B3 may include a cover inlet portion through which the fluid outside the third storage space 17 is guided to flow into the third storage space 17, and a cover discharge portion through which the fluid heat-exchanged in the third storage space 17 is discharged.

For example, outside air may be introduced from the front side to the third storage space 17 through the cover inlet portion, and may be discharged from the third storage space 17 to the front side through the cover discharge portion. However, the direction in which the outside air is introduced and discharged is not limited thereto.

The second flow f2 may be generated by a fluid generator, for example, a second fan, and may circulate through the cover inlet portion of the cover B3, the third storage space 17, and the cover discharge portion of the cover B3.

At least a part of the cover B3 may be shielded by the door 20. For example, the lower end portion of the door 20 may be formed at a position lower than the upper end portion of the cover B3.

As another example, the cover B3 may be located under the door 20. The upper end portion of the cover B3 may be formed at a position corresponding to the lower end portion of the door 20 or a position lower than the lower end portion of the door 20.

However, the relative positions of the cover B3 and the door 20 may not be limited thereto.

An inlet portion P1 through which the fluid in the first storage space 15 is introduced into the second storage space 16 and an outlet portion P2 through which the fluid heat-exchanged in the second storage space 16 is discharged to the duct 30 may be formed in the partition wall B1.

For example, the inlet portion P1 may be disposed above the front portion of the second storage space 16, and the outlet portion P2 may be disposed above the rear portion of the second storage space 16.

The first flow f1 may circulate through the inlet portion P1, the second storage space 16, and the outlet portion P2.

For example, the first heat exchanger E1 may include an evaporator.

For example, the second heat exchanger E2 may include a condenser.

The storehouse 1 may include a fluid generator disposed downstream of the first heat exchanger E1 to generate a flow. For example, the fluid generator may include a first fan F.

The first fan F may be disposed inside the second storage space 16, inside the partition wall B1, or inside the first storage space 15.

For example, the first fan F may be disposed above the first heat exchanger E1. However, the location of the first fan F is not limited thereto, and the first fan F may be provided at another location if the first fan F is disposed on the outlet side of the first heat exchanger E1.

The first fan F may be fluidly connected to the inlet portion P1 and the outlet portion P2. For example, based on the passage of the fluid, the first fan F may be provided between the inlet portion P1 and the outlet portion P2.

The fluid, which is introduced into the second storage space 16 through the inlet portion P1, may pass through the first heat exchanger E1 and the first fan F and then circulate to the duct 30 through the outlet portion P2.

FIG. 2 is a front perspective view of the storehouse according to an embodiment of the present disclosure, FIG. 3 is an exploded perspective view of the storehouse body and the heat exchange device according to an embodiment of the present disclosure, and FIG. 4 is a perspective view of the heat exchange device according to an embodiment of the present disclosure.

Referring to FIGS. 2 to 4, the storehouse 1 according to an embodiment of the present disclosure may include the storehouse body 10 defining the first storage space 15, and the door 20 provided in front of the storehouse body 10 to open or close the first storage space 15.

The door 20 may include a door handle 28 that allows a user to grip, and a display unit 25 that displays storehouse operation information.

The storehouse 1 may further include a heat exchange device 100 including a refrigeration cycle part.

The refrigeration cycle part may include a first heat exchanger 220 installed in a second storage space 16 as a first heat exchange portion, and a first fan 310 as a fluid generator. The fluid in the first storage space 15 may circulate through a space in which the first heat exchange portion is installed.

For example, the first heat exchanger 220 may include an evaporator, and the first fan 310 may include a cooling fan. In this case, the first heat exchange portion may constitute a cooling portion for generating cold air.

The refrigeration cycle part may include a compressor 121 and a second heat exchanger 123 as a second heat exchange portion, and a second fan 125 as a fluid generator. The fluid outside the third storage space 17 may circulate through a space in which the second heat exchange portion is installed.

For example, the second heat exchanger 123 may include a condenser, and the second fan 125 may include a condensing fan. In this case, the second heat exchange portion may constitute a heat dissipation portion that dissipates heat.

The heat exchange device 100 may be installed in a device accommodation space 18. The device accommodation space 18 may include a second storage space 16 in which the first heat exchanger 220 is installed, and a third storage space 17 in which the second heat exchanger 123 is installed.

The first storage space 15 and the device accommodation space 18 may be separated by a partition wall 50.

The partition wall 50 may be located between the storage space 15 and the device accommodation space 18.

For example, the partition wall 50 may vertically separate the first storage space 15 and the device accommodation space 18.

For example, the partition wall 50 may constitute a part of a body inner case 12.

The partition wall 50 may include a wall insulating material 56 (see FIG. 19) for insulating the first storage space 15 and the device accommodation space 18.

The device accommodation space 18 may be located below the first storage space 15.

The device accommodation space 18 may have a smaller volume than the first storage space 15.

The heat exchange device 100 may be located at the lower end portion of the storehouse body 10.

An inlet portion 51 through which the fluid in the first storage space 15 is introduced into the second storage space 16 of the heat exchange device 100 is defined in the partition wall 50. The inlet portion 51 may pass through the partition wall 50 to communicate with the second storage space 16 of the heat exchange device 100.

The inlet portion 51 may include a hole defined to be long in the left-and-right direction.

The storehouse 1 may further include a cover 150 that is provided in front of the heat exchange device 100 and introduces the fluid from the outside of the third storage space 17.

The cover 150 may include a cover body 151 having a size corresponding to the front surface of the heat exchange device 100, a cover inlet portion 152 through which the fluid is introduced into the third storage space 17, and a cover outlet portion 153 through which the fluid passing through the third storage space 17 of the heat exchange device 100 is discharged.

The cover inlet portion 152 and the cover outlet portion 153 may be disposed on both sides of the cover body 151.

The cover inlet portion 152 may be located in front of the second heat exchanger 123. The cover outlet portion 153 may be located in front of the compressor 121.

The fluid, which is introduced into the third storage space 17 of the heat exchange device 100 through the cover inlet portion 152, may be heat-exchanged through the second heat exchanger 123 and the compressor 121 and may be discharged to the outside of the storehouse through the cover outlet portion 153.

The second heat exchange portion of the heat exchange device 100 may be disposed in the front region of the heat exchange device 100. The second heat exchange portion may include a compressor 121, a second fan 125, and a second heat exchanger 123.

The compressor 121, the second fan 125, and the second heat exchanger 123 may be disposed in the left-and-right direction. The compressor 121, the second fan 125, and the second heat exchanger 123 may be disposed in a line.

The second fan 125 may be disposed between the compressor 121 and the second heat exchanger 123.

The second fan 125 may include an axial fan.

The first heat exchange portion of the heat exchange device 100 may be disposed in the rear region of the heat exchange device 100. The first heat exchange portion may include the first heat exchanger 220 and the first fan 310.

The first heat exchange portion further includes a heat exchanger case 200 defining a space (case accommodation portion) 205 accommodating the first heat exchanger 220. The heat exchanger case 200 may be separated from the second heat exchange portion and configured to have an insulating wall.

The case accommodation portion 205 of the heat exchanger case 200 may define at least a part of the second storage space 16.

The heat exchanger case 200 includes a case body 210 provided in the rear of the second heat exchange portion. The case body 210 may have a polyhedral shape (e.g., a hexahedral shape) with an opened upper end portion.

The first heat exchanger 220 may be disposed inside the heat exchanger case 200.

The inner space of the heat exchanger case 200 may define at least a part of the second storage space 16. The heat exchanger case 200 may include a case insulating material 213 that insulates the inner space and the outer space of the heat exchanger case 200.

The fluid, which is heat-exchanged while passing through the first heat exchanger 220, may flow to the duct 30 of the storehouse body 10 and may be supplied to the first storage space 15 through the duct discharge hole 35.

The heat exchanger case 200 may be coupled to the storehouse body 10.

The heat exchanger case 200 may be in close contact with the partition wall 50.

The heat exchanger case 200 further includes a sealing member 240 that seals the space between the heat exchanger case 200 and the partition wall 50.

The sealing member 240 may be provided on the upper surface of the heat exchanger case 200 and may be in contact with the bottom surface of the partition wall 50.

The sealing member 240 may include a gasket, an O-ring, or a square ring.

A sealing groove **210*e*, in which the sealing member 240 is installed, may be defined in a case top portion 210*c* of the heat exchanger case 200. The sealing groove 210*e* may be defined by being recessed in the case top portion 210*c***.

For example, the sealing groove **210*e* may have a quadrangular groove shape corresponding to the shape of the sealing member 240**.

Before the heat exchanger case 200 is coupled to the first storage space 15, the sealing member 240 may protrude from the heat exchanger case 200 by a predetermined height.

After the heat exchanger case 200 is coupled to the first storage space 15, the sealing member 240 is pressed by the partition wall 50 to achieve sealing. In this process, the protruding height of the sealing member 240 may be reduced or eliminated.

The heat exchange device 100 may further include a base 110 on which at least one of the first heat exchange portion and the second heat exchange portion is installed. The base 110 may have a shape corresponding to the lower end portion of the storehouse body 10.

The base 110 may form at least a part of a common plate.

It is shown that the first and second heat exchange portions are installed on the base 110 together. However, unlike this, the first and second heat exchange portions may be installed on separate bases, and the first heat exchange portion or the second heat exchange portion may be installed on the ground without a base.

For example, when the base 110 is provided with the common plate of the first and second heat exchangers, the upper surface of the base 110 may provide the installation surface of the first and second heat exchangers, the second heat exchanger 123 may be disposed on the front portion of the installation surface, and the first heat exchanger 220 may be disposed in the rear portion of the installation surface.

The compressor 121, the second fan 125, and the second heat exchanger 123 are provided on the front portion of the installation surface. The second fan 125 may be provided between the compressor 121 and the second heat exchanger 123.

The base 110 may include a compressor support portion **121*a* that supports the compressor 121. A plurality of compressor support portions 121*a* may be provided and may be coupled to legs of the compressor 121**.

The first heat exchanger 220 may be installed on the base 110. The rear portion of the base 110 may define the installation space for the first heat exchanger 220.

The heat exchange device 100 may further include a tray 130 for collecting the fluid discharged from the heat exchanger case 200, for example, water or water vapor. When the first heat exchanger 220 is configured as an evaporator, the fluid may include condensed water.

The tray 130 may include a fluid collecting surface for collecting the fluid and an edge portion protruding upward from the edge of the fluid collecting surface to prevent overflow of the fluid. The edge portion may include a wall (storage wall) that blocks the flow of collected water or water vapor so as to store the collected water or water vapor.

The heat exchanger case 200 may be seated on the upper side of the tray 130.

The heat exchanger case 200 may include a hot line pipe 260 through which a high-temperature refrigerant flows. The hot line pipe 260 may be buried in the wall surface of the heat exchanger case 200. A high-temperature refrigerant, which is condensed in the second heat exchanger 123, may flow through the hot line pipe 260, and may extend to the front of the storehouse body 10 to perform a function of preventing dew condensation.

First through holes 216*a* and 216*b*, through which the hot line pipe 260 buried in the wall surface is drawn out, may be defined in the heat exchanger case 200. The hot line pipe 260, which is drawn out of the heat exchanger case 200 through the first through holes 216*a* and 216*b*, may extend to the front of the storehouse body 10. The first through holes 216*a* and 216*b* may be referred to as "hot line through holes".

The heat exchange device 100 further includes a fan assembly 300 for generating the flow of the fluid passing through the first heat exchanger 220. The fan assembly 300 may be located inside the heat exchanger case 200, and may be provided on one side of the first heat exchanger 220. For example, the fan assembly 300 may be provided behind the first heat exchanger 220.

A part of the fan assembly 300 may protrude upward from the heat exchanger case 200 and may be connected to the lower portion of the duct 30.

The fan assembly 300 may include the first fan 310. The first fan 310 may include a centrifugal fan.

The fan assembly 300 further includes a shroud 320 on which the first fan 310 is installed to define a passage. The shroud 320 includes a fan inlet portion 323 through which the fluid passing through the first heat exchanger 220 is introduced and a fan outlet portion 326 through which the fluid passing through the first fan 310 is discharged.

The fan inlet portion 323 may be formed on the front surface of the shroud 320, and the first fan 310 may be disposed behind the fan inlet portion 323.

The fan outlet portion 326 may be formed on the upper surface of the shroud 320. The fluid, which is introduced through the fan inlet portion 323 in the axial direction of the first fan 310, may flow upward after passing through the first fan 310 and may be discharged from the shroud 320 through the fan outlet portion 326.

The storehouse 1 may further include a roller 19*a* provided in the lower end portion of the storehouse body 10 for easy movement of the storehouse 1. The rollers 19*a* may be provided on both sides of the rear portion of the storehouse body 10.

An adjustment device 19*b* for adjusting the height (flatness) of the storehouse body 10 may be provided at the front portion of the storehouse body 10.

FIG. 5 is an exploded perspective view of the heat exchange device according to an embodiment of the present disclosure, FIG. 6 is a plan view of a partial configuration of the heat exchange device according to an embodiment of the present disclosure, and FIG. 7 is a cross-sectional view taken along line 7-7' of FIG. 6.

The configuration of the heat exchange device 100 according to an embodiment of the present disclosure will be described in more detail with reference to FIGS. 5 and 6.

The tray 130 according to an embodiment of the present disclosure may include a tray body 131 defining a fluid collecting surface. For example, the tray body 131 may have a quadrangular plate shape.

The tray 130 may further include a storage wall 132 provided on the edge of the tray body 131 and protruding upward. The storage wall 132 may prevent the fluid collected in the tray 130 from overflowing.

The tray 130 may further include a support wall 133 provided on the tray body 131 to support the heat exchanger case 200. The support wall 133 may protrude upward from the tray body 131.

A plurality of support walls 133 may be provided. The plurality of support walls 133 may be spaced apart from each other in the left-and-right direction of the tray 130.

The support wall 133 may be provided to be inclined downward to the rear. Therefore, the heat exchanger case 200 supported by the support wall 133 may be disposed to be inclined downward to the rear.

A discharge passage through which the fluid is discharged is defined in the heat exchanger case 200. For example, the discharge passage may define a drain hole 208.

A drain hole 208, through which the fluid is discharged, is defined in the bottom surface of the heat exchanger case 200. The drain hole 208 may be defined in the rear portion of the bottom surface of the heat exchanger case 200. Since the heat exchanger case 200 is disposed to be inclined downward to the rear, the fluid present in the heat exchanger case 200 may be easily discharged through the drain hole 208.

The condensed water discharged through the drain hole 208 may be collected in the tray 130.

At least some storage walls 132 of the tray 130 may support at least one of the front and rear surfaces and the left and right side surfaces of the heat exchanger case 200.

A tray recessed portion 136 may be defined in at least one of the plurality of storage walls 132 of the tray 130. At least a part of a refrigerant pipe constituting the second heat exchange portion may be configured to pass through the tray recessed portion 136.

The heat exchanger case 200 may have a hexahedral shape with an opened upper end portion. The heat exchanger case 200 may include a case front portion 210*a*, a case side portion 210*b* extending rearward from both sides of the case front portion 210*a*, a case top portion 210*c* forming the upper end portion of the heat exchanger case 200, and a case rear portion 210*d* facing the case front portion 210*a*.

The heat exchanger case 200 may include a case extension portion 215 that further extends rearward from the case top portion 210*c*.

When the heat exchanger case 200 is coupled to the storehouse body 10, that is, the first storage space 15, the case extension portion 215 may be understood as a portion located adjacent to or in contact with the lower end portion of the rear wall of the storehouse body 10.

The first through holes 216*a* and 216*b*, through which the hot line pipe 260 is drawn out, may be defined in the heat exchanger case 200.

The first through holes 216*a* and 216*b* may include one through hole 216*a* through which an outlet pipe extending from the outlet side of the second heat exchanger 123 in the hot line pipe 260 passes; and other through hole 216*b* through which an outlet pipe extending toward the front side of the storehouse body 10 in the hot line pipe 260 passes.

The one through hole 216*a* may be defined at a position adjacent to the pipe on the outlet side of the second heat exchanger 123. For example, the one through hole 216*a* may be defined in the case side portion 210*b*.

The other through hole 216*b* may be defined at a position adjacent to the pipe on the door side. The pipe on the door side may be understood as a refrigerant pipe disposed inside or near the first wall defining at least a part of the first storage space in order to prevent dew from being formed on a portion adjacent to the door. For example, the other through hole 216*b* may be defined in the case front portion 210*a*.

In the heat exchanger case 200, second through holes 217*a* and 217*b* through which a suction line heat exchanger (SLHX) 270 is drawn out may be defined. The SLHX 270 may include a first refrigerant pipe 276 and a second refrigerant pipe 275. For example, a low-pressure gas refrigerant may flow through the first refrigerant pipe 276, and a condensed refrigerant may flow through the second refrigerant pipe 275.

The first refrigerant pipe 276 and the second refrigerant pipe 275 may be disposed adjacent to each other to enable heat exchange.

For example, the first refrigerant pipe 276 and the second refrigerant pipe 275 may be disposed in contact with each other to enable heat exchange. The first refrigerant pipe 276 and the second refrigerant pipe 275 may be contacted by soldering, but the contact method is not limited thereto.

The first through holes 217*a* and 217*b* may include one through hole 217*a* through which an outlet pipe extending from the front of the heat exchanger case 200 in the SLHX 270 passes; and other through hole 217*b* through which an outlet pipe drawn out from the inner surface of the heat exchanger case 200 in the SLHX 270 passes.

The one through hole 217*a* may be defined at a position adjacent to the compressor 121. For example, the one through hole 217*a* may be defined in the case front portion 210*a*.

The other through hole 217*b* may be defined at a position adjacent to the first heat exchanger 220. The other through hole 217*b* may be defined on the inner surface of the heat exchanger case 200.

The heat exchanger case 200 may include a third through hole 218. The third through hole 218 may be understood as a hole through which a heat insulating foam is injected so as to form a heat insulating material in the heat exchanger case 200. The third through hole 218 may be defined in, for example, the case side portion 210*b*.

The fan assembly 300 may include a shroud 320 on which the first fan 310 is installed. The shroud 320 may include a first part 320*a* defining a fan seating portion 325 on which the first fan 310 is seated.

The first part 320*a* may define the rear portion of the shroud 320, and the fan seating portion 325 may be defined on the front surface of the first part 320*a*.

The first part 320*a* may further include a drain guide 327 for guiding the fluid generated in the fan assembly 300 to the lower side of the fan assembly 300. The drain guide 327 may protrude from the front surface of the first part 320*a* and may extend obliquely downward toward the lower side of the first fan 310.

The shroud 320 includes a second part 320*b* coupled to the first part 320*a*. The second part 320*b* may define the front portion of the shroud 320.

The second part 320*b* may define a fan inlet portion 323 through which cold air is introduced into the first fan 310.

The first and second parts 320*a* and 320*b* may define an installation space for the first fan 310 in the shroud 320, and may define a cold air passage.

The shroud 320 may further include a wall coupling portion 324 defining the upper surface thereof. The wall coupling portion 324 may extend forward from the upper end portion of the second part 320*b* and may be coupled to the partition wall 50.

The wall coupling portion 324 may be provided in front of the fan outlet portion 325.

The cold air, which is introduced into the heat exchanger case 200, may pass through the first heat exchanger 220, may be introduced in the axial direction of the first fan 310, and may be discharged through the first fan 310 in the radial direction.

The cold air, which is introduced into the heat exchanger case 200, may pass through the first heat exchanger 220 and may be sucked through the first fan 310. The fluid discharged from the first fan 310 may flow through the duct 30.

A passage is defined in the heat exchanger case 200. The passage may be defined in the case accommodation portion 205 in which the first heat exchanger 220 and the fan assembly 300 are installed.

The case accommodation portion 205 may include a first accommodation space 205*a* defining an area in which the first heat exchanger 220 is installed and a second accommodation space 205*b* defining an area in which the fan assembly 300 is installed.

The first accommodation space 205*a* may be defined in the front portion of the case accommodation portion 205, and the second accommodation space 205*b* may be defined in the rear portion of the case accommodation portion 205.

As an example, when the first heat exchanger 220 is configured as an evaporator, the first heat exchanger may include a refrigerant pipe 221 through which a refrigerant flows, and a fin 222 coupled to the refrigerant pipe 221. The refrigerant pipe 221 may be formed in multiple stages, and both sides of the refrigerant pipe 221 may have a bent shape.

A plurality of fins 222 may be provided. The plurality of fins 222 may be spaced apart from each other in the left-and-right direction. The fin 222 may extend in the front-and-rear direction.

The heat exchange surface of the fin 222 may be disposed to face the left-and-right inner surfaces of the heat exchanger case 200.

Due to the refrigerant pipe 221 and the fin 222, the first heat exchanger 220 may be configured to have a hexahedral shape as a whole. The case accommodation portion 205 may be defined by recessing downward from the upper end portion of the heat exchanger case 200 to correspond to the shape of the first heat exchanger 220.

A drain hole 208, through which the fluid generated in the first heat exchanger 220 or the first fan 310 is discharged, may be defined in the heat exchanger case 200. The drain hole 208 may be defined in the inner lower surface of the heat exchanger case 200.

The drain hole 208 may be defined in the lower surface 207 of the case accommodation portion 205.

The drain hole 208 may be defined below the second accommodation space 205*b*. That is, the drain hole 208 may be defined to vertically overlap the second accommodation space 205*b*.

The lower surface 207 of the case accommodation portion 205 may be inclined downward toward the drain hole 208.

Therefore, the fluid generated in the first heat exchanger 220 or the first fan 310 may fall and easily flow toward the drain hole 208.

The drain hole 208 may be defined in the central portion of the heat exchanger case 200 with respect to the left-and-right direction. That is, the distance from the drain hole 208 to the left end of the heat exchanger case 200 may be equal to the distance from the drain hole 208 to the right end of the heat exchanger case 200.

The left portion and the right portion of the heat exchanger case 200 may be symmetrical with respect to the drain hole 208.

A center line (ℓ 1) in the front-and-rear direction passing through the center of the first heat exchanger 220 may pass through the center of the heat exchanger case 200.

The center line in the front-and-rear direction passing through the center of the first heat exchanger 220 may pass through the center of the drain hole 208.

A tube through which a refrigerant flows (hereinafter referred to as a refrigerant tube) may be buried in the wall surface of the heat exchanger case 200.

The refrigerant tube may include a hot line pipe 260. The refrigerant heat-exchanged in the second heat exchanger 123 may flow through the hot line pipe 260. The hot line pipe 260 may be drawn out of the heat exchanger case 200 through the first through holes 216*a* and 216*b*.

One end portion of the hot line pipe 260 may pass through one through hole 216*a* of the first through holes 216*a* and 216*b*, and may extend to the side of the heat exchanger case 200. One end of the hot line pipe 260 may be connected to the outlet side of the second heat exchanger 123.

The other end portion of the hot line pipe 260 may pass through the other through hole 216*b* of the first through holes 216*a* and 216*b*, and may extend forward from the heat exchanger case 200. In addition, the other end portion of the hot line pipe 260 may extend to the front portion of the storehouse body 10.

The hot line pipe 260 may be buried in the case insulating material 213 provided in the heat exchanger case 200. Therefore, the amount of heat emitted from the hot line pipe 260 may be prevented from being transferred toward the case accommodation portion 205.

The refrigerant tube may further include an SLHX 270. The SLHX 270 may be configured so that the first refrigerant pipe through which the refrigerant passing through the first heat exchanger 220 flows exchanges heat with the second refrigerant pipe through which the refrigerant heat-exchanged in the second heat exchanger 123 flows.

The second refrigerant pipe may include a capillary configured to depressurize the refrigerant.

The first refrigerant pipe and the capillary may contact each other. For example, the first refrigerant pipe and the capillary may be soldered.

The SLHX 270 may be formed to be long, and may be bent multiple times so as to be installed on the wall surface of the heat exchanger case 200 having a limited volume. The SLHX 270 includes a first heat exchange portion 270*a* disposed below the heat exchanger case 200 in the vertical direction, a second heat exchange portion 270*b* connected to the first heat exchange portion 270*a* and disposed in the central portion of the heat exchanger case 200, and a third heat exchange portion 270*c* connected to the second heat exchange portion 270*b* and disposed above the heat exchanger case 200.

The SLHX 270 may be buried in the case insulating material 213. Therefore, the amount of heat emitted from the SLHX 270 may be prevented from being transferred toward the case accommodation portion 205.

The cover 150 may constitute at least a part of the third wall of the third storage space 17.

The cover 150 may define the lower appearance of the storehouse 1 when the door 20 is opened.

Coupling brackets 154 coupled to the side walls of the device accommodation space 18 may be provided on both sides of the cover 150. The coupling brackets 154 may protrude outward from both ends of the cover body 151.

A plurality of coupling brackets 154 may be provided at the side end portion of the cover body 151 and spaced apart from each other in the vertical direction.

For example, the coupling bracket 154 may define a coupling hole, and a predetermined coupling member may be inserted into the coupling hole and coupled to the side wall of the device accommodation space 18.

The height of the upper end portion of the cover 150 may correspond to the height of the bottom of the partition wall 50. The opened front end portion of the device accommodation space 18 may be shielded by the cover 150.

FIG. 8 is a perspective view showing the configuration of the heat exchanger case according to an embodiment of the present disclosure, FIG. 9 is an exploded perspective view of the heat exchanger case according to an embodiment of the present disclosure, FIG. 10 is a front view of the heat exchanger case according to an embodiment of the present disclosure, FIG. 11 is a cross-sectional view taken along line 11-11' of FIG. 10, FIG. 12 is a side view of the heat exchanger case according to an embodiment of the present disclosure, and FIG. 13 is a cross-sectional view taken along line 13-13' of FIG. 12.

Referring to FIGS. 8 to 13, the heat exchanger case 200 according to an embodiment of the present disclosure may include a case body 210 having a box shape with an opened upper end portion. For example, the case body 210 may have a hexahedral shape with an opened upper end portion.

The heat exchanger case 200 includes a case accommodation portion 205 in which the first heat exchanger 220 and the fan assembly 300 can be installed.

The case accommodation portion 205 may be formed by being recessed downward from the upper end portion of the heat exchanger case 200.

The inner surface of the heat exchanger case 200 defines a bottom portion 207 provided below the first heat exchanger 220 or the fan assembly 300. The bottom portion 207 may define a bottom surface of the case accommodation portion 205.

The bottom portion 207 may define a fluid collecting surface through which condensed water or defrost water generated in the first heat exchanger 220 and the fan assembly 300 is collected or flows.

The bottom portion 207 may define a drain hole 208 through which the fluid is discharged to the tray 130. The fluid collected in the bottom portion 207 may flow to the drain hole 208.

The heat exchanger case 200 may include a multi-faceted portion defining an outer appearance. The multi-faceted portion may include a case front portion 210*a*, a case side portion 210*b*, a case top portion 210*c*, a case rear portion 210*d*, and a case bottom portion 210*f*.

A plurality of through holes may be defined in the multi-faceted portion.

The plurality of through holes may include first through holes 216*a* and 216*b* through which the hot line pipe 260 passes. The first through holes 216*a* and 216*b* may include one through hole 216*a* through which one side of the hot line pipe 260 passes and other through hole 216*b* through which the other side of the hot line pipe 260 passes.

The one through hole 216*a* and the other through hole 216*b* may be defined on different surfaces of the heat exchanger case 200.

The one through hole 216*a* may be defined in the case side portion 210*b*, and the other through hole 216*b* may be defined n the case front portion 210*c*.

The plurality of through holes may include second through holes 217*a* and 217*b* through which the SLHX 270 passes. The first through holes 217*a* and 217*b* may include one through hole 217*a* through which one side of the heat exchanger 270 passes and other through hole 217*b* through which the other side of the heat exchanger 270 passes.

The one through-hole 217*a* may be defined on the outer surface of the heat exchanger case 200, and the other through hole 217*b* may be defined on the inner side surface of the heat exchanger case 200.

The plurality of through holes may include a third through hole 218 through which an insulating foam is injected so as to form an insulating wall of the heat exchanger case 200. The third through hole 218 may be defined in the case side portion 210*b*.

A sealing member 240 for sealing the partition wall 50 and the heat exchanger case 200 to each other may be installed in the case top portion 210*c*. The sealing member 240 may be seated in the sealing groove 210*e* recessed along the edge of the case top portion 210*c*.

The case bottom portion 210*f* may be supported by the support wall 133.

The case bottom portion 210*f* may be inclined downward toward the drain hole 208. For example, the case bottom portion 210*f* may be inclined downward to the rear.

Correspondingly, the support wall 133 may be inclined downward in a direction toward the drain hole 208. The support wall 133 may be inclined downward to the rear.

The case bottom portion 210*f* may extend rearward from the lower end portion 210*a*1 (front lower end portion) of the case front portion 210*a* and may be connected to the case rear portion 210*d*.

The case bottom portion 210*f* may include a bottom inclined portion 210*f*2 extending downward from the front lower end portion 210*a*1 to the rear.

The case bottom portion 210*f* may include a bottom lower end portion 210*f*1 extending rearward from the bottom inclined portion 210*f*2 and connected to the case rear portion 210*d*.

The bottom lower end portion 210*f*1 may include a flat surface.

The drain hole 208 may pass through the bottom lower end portion 210*f*1.

The bottom lower end portion 210*f*1 may be formed at a lower position than the front lower end portion 210*a*1.

When the heat exchanger case 200 is coupled to the partition wall 50 in a state where the case bottom portion 210*f* is supported by the support wall 133, the heat exchanger case 200 may move upward.

The heat exchanger case 200 may be in a state of being spaced upward apart from the fluid collecting surface of the tray 130 by the support wall 133. Therefore, the heat exchanger case 200 may not be submerged in the condensed fluid collected in the tray 130.

The drain hole 208 may be located at the center with respect to the left-and-right direction of the heat exchanger case 200. When the center line (80) that bisects the heat exchanger case 200 to the left and right is defined, the center line (80) may pass through the drain hole 208.

Based on the center line (80), the heat exchanger case 200 may be bilaterally symmetrical.

The drain hole 208 may be configured by combining a first hole defining portion 208*a* provided in the inner case 212 of the heat exchanger case 200 and a second hole defining portion 208*b* provided in the outer case 211.

The bottom portion 207 of the heat exchanger case 200 may be inclined downward from the edge toward the center.

The drain hole 208 may be defined in the center of the bottom portion 207.

Based on FIG. 11 (based on the left-and-right direction of the heat exchanger case), the bottom portion 207 may include a first bottom portion 207*a* extending obliquely downward from the left end edge toward the center by a first predetermined angle (θ1), and a second bottom portion 207*b* extending downward from the right end edge toward the center by a second predetermined angle (θ2).

The first predetermined angle (θ1) and the second predetermined angle (θ2) may have the same value. For example, the first and second predetermined angles (θ1 and θ2) may be in a range of 7° to 10°.

Since the first predetermined angle (θ1) and the second predetermined angle (θ2) have the same value, the first and second bottom portions 207*a* and 207*b* may be symmetrical left and right about the drain hole 208, and the thickness of the lower heat insulating wall of the heat exchanger case 200 may be formed evenly based on the drain hole 208.

As another example, the first predetermined angle (θ1) and the second predetermined angle (θ2) may have different values. However, even in such a case, the first and second predetermined angles (θ1 and θ2) may be in a range of 7° to 10°.

As described above, since the bottom portion 207 is inclined downward toward the drain hole 208, the condensed fluid collected in the bottom portion 207 can be easily discharged into the drain hole 208.

Based on FIG. 13 (based on the front-and-rear direction of the heat exchanger case), the bottom portion 207 may include a first inclined portion 207*c* extending downward from the front edge by a third predetermined angle (θ3) in a direction (rearward) closer to the drain hole 208, and a second inclined portion 207*d* extending downward from the first inclined portion 207*c* toward the drain hole 208 by a fourth predetermined angle (θ4).

The first inclined portion 207*c* may be defined below the first heat exchanger 220.

The second inclined portion 207*d* may be located closer to the fan assembly 300 than the first inclined portion 207*c*.

The drain hole 208 may be defined closer to the center of the fan assembly 300 than the center of the first heat exchanger 220.

In order to further secure a space in which the fan assembly 300 is installed, the fourth predetermined angle (θ4) may be greater than the third predetermined angle (θ3). That is, since the fourth predetermined angle (θ4) is relatively great, the space of the case accommodation portion 205 defined above the second inclined portion 207*d* can be formed to be large.

Since the fourth predetermined angle (θ4) is greater than the third predetermined angle (θ3), the condensed water generated in the first heat exchanger 220 may be easily discharged to the drain hole 208 without reducing the flow rate while passing through the first inclined portion 207*c* and the second inclined portion 207*d*.

However, although the fourth predetermined angle (θ4) is greater than the third predetermined angle (θ3), the third and fourth predetermined angles (θ3 and θ4) may be in a range of 7° to 10°.

Based on FIG. 13 (based on the front-and-rear direction of the heat exchanger case), the bottom portion 207 may further include a third inclined portion 207*e* extending downward from the rear edge toward the drain hole 208 by a fifth predetermined angle (θ5).

Since the uppermost end of the third inclined portion 207*e* is located lower than the uppermost end of the first inclined portion 207*c* or the uppermost end of the second inclined portion 207*d*, a large space in which the fan assembly 300 is installed can be secured.

The fifth predetermined angle (θ5) may have the same value as the third predetermined angle (θ3).

The fifth predetermined angle (θ5) may have a smaller value than the fourth predetermined angle (θ4).

The fifth predetermined angle (θ5) may be in a range of 7° to 10°.

The first to fifth setting angles may be determined as appropriate values in consideration of the thickness of the case insulating material 213 of the heat exchanger case 200, the depth of the drain hole 208, and the arrangement of the first heat exchanger 220 and the fan assembly 300.

The SLHX 270 and the hot line pipe 260 may be provided in the heat exchanger case 200.

The heat exchanger case 200 includes an outer case 211 defining an outer surface and an inner case 212 disposed inside the outer case 211.

The outer case 211 may have a hexahedral shape with an opened upper end.

The inner case 212 may have a hexahedral shape with an opened upper end.

The outer case 211 may be formed to be greater than the inner case 212 so as to accommodate the inner case 212 therein.

The first through holes 216*a* and 216*b* through which the hot line pipe 260 pass may be defined in the outer case 211.

One through hole 217*a* of the second through holes 217*a* and 217*b* through which the SLHX 270 passes may be defined in the outer case 211. The other through hole 217*b* of the second through holes 217*a* and 217*b* may be defined n the inner case 212.

A first assembling hole 211*a* to be assembled with the inner case 212 by a predetermined coupling member is defined in the outer case 211. The coupling member may be inserted into the first assembling hole 211*a* and coupled to the second assembling hole 212*c* of the inner case 212.

A plurality of first assembling holes 211*a* may be defined along the edge of the outer case 211. A plurality of second assembling holes 212*c* may be defined along the edge of the inner case 212.

The outer case 211 further includes a support bracket 214 configured to support the inner case 211. The support bracket 214 may be provided on the inner surface of the outer case 211 and may protrude from the inner surface.

The support bracket 214 may support the outer case 211 and the inner case 212 so that the outer case 211 and the inner case 212 are not deformed when the case insulating material 213 is formed between the outer case 211 and the inner case 212.

A plurality of support brackets 214 may be provided along the inner surface of the outer case 211.

The support bracket 214 may be provided on the inner surface of the first assembly hole 211*a*. When the first and second assembling holes 211*a* and 212*c* are coupled by a predetermined coupling member, the coupling member may be accommodated in the support bracket 214.

The bottom surface of the outer case 211 may include a second hole defining portion 208*b* for discharging the fluid toward the tray 130. The second hole defining portion 208*b* may include a through hole.

The second hole defining portion 208*b* may communicate with the first hole defining portion 208*a* of the inner case 212. The first hole defining portion 208*a* may protrude downward from the bottom surface of the inner case 212 and may be connected to the second hole defining portion 208*b*.

The first and second hole defining portions 208*a* and 208*b* may define a drain hole 208.

A case accommodation portion 205 in which the first heat exchanger 220 and the fan assembly 300 are located may be formed in the inner space of the inner case 212.

The inner case 212 may include an insertion portion 212*a* inserted into the outer case 211, and an edge portion 212*b* extending downward from the top portion 210*c* of the inner case 212 and forming the edge of the inner case 212.

The top portion 210*c* of the inner case 212 may define the case top portion 210*c* of the heat exchanger case 200.

A sealing groove 210*e*, in which a sealing member 240 is installed, may be defined in the top portion 210*c* of the inner case 212. The sealing groove 210*e* may be defined by being recessed in the top portion 210*c*.

For example, the sealing groove 210*e* may have a quadrangular groove shape corresponding to the shape of the sealing member 240.

The edge portion 212*b* may be disposed outside the outer case 211.

The second assembling hole 212*c* may be defined in the edge portion 212*b*.

A refrigerant tube through which a refrigerant flows may be installed on the wall surface of the heat exchanger case 200.

The heat exchanger case 200 may be formed between the outer case 211 and the inner case 212 to define the installation space in which the refrigerant tube is installed.

The refrigerant tube may include a hot line pipe 260 and a heat exchanger 270.

The refrigerant tube may be attached to or coupled to the outer case 211 or the inner case 212.

After the refrigerant tube is disposed in the installation space of the heat exchanger case 200, a liquid insulating foam may be injected through the third through hole 218. As an example, the insulating foam may include polyurethane.

When the insulating foam is solidified, the case insulating material 213 may be provided. Insulation can be made between the case accommodation portion 205 and the outside of the heat exchanger case 200 by the case insulating material 213.

FIG. 14 is a plan view showing a state in which the compressor, the second heat exchanger, and the tray pipe are connected, according to an embodiment of the present disclosure, and FIG. 15 is a view showing a state in which the tray pipe is installed in the tray, according to an embodiment of the present disclosure.

Referring to FIGS. 14 and 15, the compressor 121 according to the embodiment of the present disclosure may include a compressor suction pipe 121*b* through which a refrigerant is sucked.

The compressor suction pipe 121*b* may be connected to a first refrigerant pipe 276 through which the refrigerant heat-exchanged in the first heat exchanger 220 flows. The compressor suction pipe 121*b* may introduce the refrigerant from the first refrigerant pipe 276.

The compressor 121 may include a compressor discharge pipe 121*c* through which the high-pressure refrigerant compressed in the compressor 121 is discharged.

A tray pipe 290 may be connected to the compressor discharge pipe 121*c*. The tray pipe 290 may be understood as a pipe that is disposed on the tray 130 to help evaporating the fluid stored in the tray 130. The high-temperature refrigerant discharged from the compressor discharge pipe 121*c* may flow to the tray pipe 290.

The compressor discharge pipe 121*c* may be connected to a pipe inlet portion 291 defining one end portion of the tray pipe 290.

The compressor suction pipe 121*b* and the compressor discharge pipe 121*c* may extend in different outward directions from a shell forming the outer appearance of the compressor 121.

The tray pipe 290 may be introduced into the fluid collecting space of the tray 130 through the tray recessed portion 136.

The tray pipe 290 may be disposed along the edge of the tray 130.

The tray pipe 290 may include a bent pipe.

For example, the tray pipe 290 may include a first part 290*a* connected to the pipe inlet portion 291 and extending along the first wall of the tray 130, and a second part 290*b* connected to the first part 290*a* and extending along the second wall of the tray 130. The first and second parts 290*a* and 290*b* may be bent.

The tray pipe 290 may include a third part 290*c* connected to the second part 290*b* and extending along the third wall of the tray 130; and a fourth part 290*d* connected to the third part 290*c* and extending along the fourth wall of the tray 130. The third and fourth parts 290*c* and 290*d* may be bent.

The tray pipe 290 may include a fifth part 290*e* connected to the fourth part 290*d* and extending along the first wall of the tray 130. The fifth part 290*e* may be bent from the fourth part 290*d*.

The fifth part 290*e* and the first part 290*a* may extend along the first wall of the tray 130.

For example, the first to fourth walls of the tray 130 may include a front wall, one side wall, a rear wall, and the other side wall, respectively.

The plurality of walls of the tray 130 may include walls that block the flow of water or water vapor collected in the tray 130 and store the water or water vapor.

The tray pipe 290 may include a pipe outlet portion 292 connected to the fifth part 290*e* and defining an outlet side end portion of the refrigerant. The pipe outlet portion 292 may extend to the outside of the tray 130 through the tray recessed portion 136.

The pipe outlet portion 292 may be connected to a second heat exchanger inlet pipe 123*a*. The second heat exchanger inlet pipe 123*a* may be connected to the inlet side of the second heat exchanger 123 so that the refrigerant is introduced into the second heat exchanger 123.

The second heat exchanger inlet pipe 123*a* may constitute at least a part of the second heat exchanger 123.

A second heat exchanger outlet pipe 123*b* may be connected to the outlet side of the second heat exchanger 123. The second heat exchanger outlet pipe 123*b* may guide the discharge of the refrigerant condensed in the second heat exchanger 123, and may constitute at least a part of the second heat exchanger 123.

The second heat exchanger outlet pipe 123*b* may be connected to the second refrigerant pipe 275.

The tray 130 may include a tray body 131 defining the bottom surface, and a storage wall 132 protruding upward from the tray body 131 and blocking the flow of collected water or water vapor so that the collected water or water vapor is stored.

An embodiment related to the storage wall is as follows. The tray may include any one of the following embodiments or a combination of two or more of the following embodiments.

The storage wall 132 may be disposed around the tray 130.

The storage wall 132 may include a through hole through which a fluid or an object passes.

The storage wall 132 may include a through hole passing therethrough.

For example, the storage wall 132 may include a tray recessed portion 136 through which the tray pipe 290 passes. The tray recessed portion 136 may define a through hole passing through the inside of the tray 130.

The storage wall 132 may be configured to include a plurality of walls along the edge of the tray 130. The tray recessed portion 136 may be formed in at least one wall of the plurality of walls.

The storage wall may include a first portion 132*a* having a first height H1, and a second portion 132*b* having a second height H2 higher than the first height.

A through hole may be provided in the vicinity of the first portion 132*a*. For example, the tray recessed portion 136 may define a space on one side of the first portion 132*a*.

The tray recessed portion 136 may be defined by the first portion 132*a* and the second portion 132*b*.

The tray recessed portion 136 may be formed in a plurality of walls constituting the storage wall 132.

For example, the tray recessed portion 136 may include a first recessed portion 136*a* in the first wall of the storage wall 132.

The tray recessed portion 136 may include a second recessed portion 136*b* in the second wall of the storage wall 132.

The tray recessed portion 136 may include a third recessed portion 136*c* in the third wall of the storage wall 132.

The tray recessed portion 136 may include a fourth recessed portion 136*d* in the fourth wall of the storage wall 132.

The second portion 132*b* of the storage wall 132 may include a portion configured to restrict the movement of the second wall in at least one direction. The second wall may include an outer wall of the heat exchanger case 200.

As an example, when the heat exchanger case 200 moves toward the partition wall 50, the outer wall of the heat exchanger case 200 may be guided by the second portion 132*b* and may be moved without shaking.

The second portion 132*b* of the storage wall 132 may include a support jaw formed in a direction different from a direction in which the water or water vapor is discharged.

The second portion 132*b* of the storage wall 132 may be provided to restrict the movement in a direction different from a direction in which the water or water vapor is discharged.

At least a part of the second wall may be disposed to be accommodated in the inner space of the tray 130. For example, at least a part of the outer wall of the heat exchanger case 200 may be disposed to be accommodated in the inner space of the tray 130.

The storage wall 132 may include a portion configured to restrict the movement of the second wall in at least one direction, and a through hole may be provided between the storage wall 132 and the second wall.

The storehouse 1 may include a fluid generator disposed in the vicinity of the tray 130 to allow the fluid to flow into or out of the tray 130 through the space defined between the tray 130 and the second wall.

For example, the fluid generator may include a second fan 125.

An embodiment related to the tray 130 and the flow generator is as follows. The tray may include any one of the following embodiments or a combination of two or more of the following embodiments.

A through hole may be defined between the tray 130 and the second wall. The tray 130 may include a bottom surface, and a storage wall 132 protruding upward from the bottom surface and blocking the flow of the collected water or water vapor so that the collected water or water vapor is stored.

The storage wall 132 may include a first portion 132*a* having a first height H1, and a second portion 132*b* having a second height H2 higher than the first height. A through hole may be provided in the vicinity of the first portion.

For example, the through hole may include the tray recessed portion 136.

The first portion 132*a* of the storage wall 132 may include a portion disposed closer to the fluid generator than the second portion 132*b* of the storage wall 132.

The minimum distance between the first portion 132*a* of the storage wall 132 and the fluid generator may be less than the minimum distance between the second portion 132*a* of the storage wall 132 and the fluid generator.

The fluid generator may include a portion disposed downstream of the through hole, and the fluid in the inner space of the tray may be introduced into the fluid generator through the through hole.

The fluid generator may include a portion disposed upstream of the through hole, and the fluid passing through the fluid generator may be introduced into the inner space of the tray.

The fluid generator may include a portion disposed to overlap the through hole, and the fluid passing through the fluid generator may be introduced into the inner space of the tray, or the fluid in the inner space of the tray may be introduced into the fluid generator.

For example, the first fan 125 and the first tray recessed portion 136*a* may be disposed to overlap each other in the front-and-rear direction.

FIG. 16 is a cross-sectional view showing a state in which the heat exchanger case is seated on the upper side of the tray, according to the embodiment of the present disclosure, FIG. 17 is a cross-sectional view taken along line 17-17' of FIG. 16, and FIG. 18 is a cross-sectional view showing a state in which the heat exchanger case is moved upward, according to the embodiment of the present disclosure.

Referring to FIGS. 15 and 16 to 18 together, the heat exchanger case 200 according to the embodiment of the present disclosure may be provided above the tray 130.

The tray 130 may further include a support wall 133 provided on the tray body 131 to support the heat exchanger case 200. The support wall 133 may protrude upward from the tray body 131.

The upper end of the support wall 133 may support the heat exchanger case 200.

The support wall 133 may support the heat exchanger case 200 so that the bottom surface of the heat exchanger case 200 is spaced upward apart from the top surface of the tray body 131.

Due to the support wall 133, the heat exchanger case 200 may not be submerged in the fluid collected in the tray 130.

Due to the support wall 133, when the heat exchanger case 200 is coupled to the partition wall 50, the upward movement distance may not be large. Accordingly, the coupling of the heat exchanger case 200 to the partition wall 50 can be made stably.

The support wall 133 may have a bar shape with an empty interior.

The inner space of the support wall 133 may define a protrusion collecting space 133*d* in which the fluid is collected. The protrusion collecting space 133*d* may be understood as a flow space through which the fluid flows.

The support wall 133 may include an opened upper end portion.

The support wall 133 may include a support front portion 133*a* defining a front surface, two support side portions 133*b* extending rearward from both sides of the support front portion 133*a*, and a support rear portion 133*c* connecting the rear ends of the two support side portions 133*b*.

The support front portion 133*a*, the two support side portions 133*b*, and the support rear portion 133*c* may define a fluid collecting space 133*d* thereinside.

The upper end portions of the support front portion 133*a*, the two support side portions 133*b*, and the support rear portion 133*c* may be opened, and the fluid may be introduced into the fluid collecting space 133*d* of the support wall 133 through the opened upper end portions.

The support wall 133 may define a flow hole 133*e* through which the fluid collected on the upper surface of the tray body 131 can be introduced into the fluid collection space 133*d*. Of course, the fluid in the fluid collecting space 133*d* may flow out to the upper surface of the tray body 131 through the flow hole 133*e*. Due to the flow hole 133*e*, the fluid flow in the tray 130 may be improved.

The flow hole 133*e* may be defined in the support side portion 133*b*.

The flow hole 133*e* may be defined in the two support side portions 133*b*.

A plurality of support walls 133 may be provided.

The plurality of support walls 133 may be spaced apart from each other in the left-and-right direction of the tray 130. The bottom surface of the heat exchanger case 200 may be stably supported by the plurality of support walls 133.

The support wall 133 may be provided to be inclined downward to the rear. Therefore, the heat exchanger case 200 supported by the support wall 133 may be disposed to be inclined downward to the rear.

The case bottom portion 210*f* may include a bottom inclined portion 210*f*2 extending downward from the lower end portion of the case front portion 210*a* to the rear.

The case bottom portion 210*f* may include a bottom lower end portion 210*f*1 extending rearward from the bottom inclined portion 210*f*2 and connected to the case rear portion 210*d*.

The bottom lower end portion 210*f*1 may include a flat surface.

The drain hole 208 may pass through the bottom lower end portion 210*f*1.

The bottom lower end portion 210*f*1 may be formed at a lower position than the lower end portion of the case front portion 210*a*.

Corresponding to the downwardly inclined shape of the heat exchanger case 200, the support wall 133 may include a downwardly inclined surface to the rear.

The height of the support front portion 133*a* of the support wall 133 may form the greatest height Hf of the support wall 133.

The support wall 133 may be configured to include a portion whose height decreases toward the rear from the support front portion 133*a*.

The support side portion 133*b* of the support wall 133 may include a support inclined portion 133*b*2 extending downward from the support front portion 133*a* to the rear.

The support inclined portion 133*b*2 may support the bottom inclined portion 210*f*2 of the heat exchanger case 200.

The flow hole 133*e* may be defined in the support inclined portion 133*b*2.

The support side portion 133*b* may further include a support flat portion 133*b*1 extending rearward from the support inclined portion 133*b*2. The support flat portion 133*b*1 may include a flat surface with no height change.

The support flat portion 133*b*1 may support the bottom lower end portion 210*f*1 of the heat exchanger case 200.

A height Hr of the support flat portion 133*b*1 may be less than a height Hf of the support front portion 133*a*.

The height Hr of the support flat portion 133*b*1 may be the same as the height of the support rear portion 133*c*.

The height Hf of the support front portion 133*a* or the height Hr of the support flat portion 133*b*1 may be lower than the height of the second portion 132*b* of the storage wall 132.

The first portion of the support wall 133, for example, the support flat portion 133*b*1 is disposed closer to the drain hole 208 than the second portion of the support wall 133, for example, the support rear portion 133*c*. Accordingly, the fluid may be easily discharged from the inside of the heat exchanger case 200.

The tray body 131 defines a wide fluid collecting surface, and the storage wall 132 has a relatively low height. Thus, the fluid stored in the tray 130 overflows to the outside of the tray 130.

An embodiment related to the tray 130 and the heat exchanger is as follows. The tray may include any one of the following embodiments or a combination of two or more of the following embodiments.

At least a part of the refrigerant pipe connected to the first heat exchanger 220 and the refrigerant pipe connected to the second heat exchanger 123 may be disposed to pass through a space defined between the tray 130 and the second wall.

The second wall may be provided as a wall in which a discharge passage is defined in a part of a plurality of walls. For example, the bottom surface of the heat exchanger case 200 may be provided as a wall defining the drain hole 208.

At least a part of the refrigerant pipe connected to the first heat exchanger 220 and the refrigerant pipe connected to the second heat exchanger 123 may be disposed to pass through a space defined between the tray 130 and the wall where the discharge passage is defined.

A compressor may be provided upstream of the second heat exchanger 123, and at least a part of the refrigerant pipe between the compressor 121 and the second heat exchanger 123 may be disposed to pass through one side of the tray 130 or disposed in a part of the second wall.

A first heat exchanger 220 may be provided downstream of the second heat exchanger 123, and at least a part of the refrigerant pipe between the first heat exchanger 220 and the second heat exchanger 123 may be disposed in a part of the second wall while being in contact with the refrigerant pipe flowing out from the first heat exchanger 220.

FIG. 19 is a cross-sectional view showing a state in which the heat exchange device is disposed in the device accommodation space, according to an embodiment of the present disclosure, and FIG. 20 is a cross-sectional view showing a state in which the heat exchanger case is in contact with the partition wall, according to an embodiment of the present disclosure.

A method for assembling the heat exchange device 100 with the storehouse body 10 and an assembly structure, according to an embodiment of the present disclosure, will be described with reference to FIGS. 19 and 20.

The first heat exchanger 220 may be accommodated in the heat exchanger case 200.

The second heat exchanger 123 and the heat exchanger case 200 in which the first heat exchanger 220 is installed may be installed on the base 110. The compressor 121 and the second fan 125 may be installed on the base 110 together.

The second heat exchanger 123, the compressor 121, and the second fan 125 may be installed in the third storage space 17.

The base 110 may be configured as a common plate for the first and second heat exchangers 220 and 123, and may be configured as a separate plate for separately installing the first and second heat exchangers 220 and 123.

The heat exchange device 100 may be manufactured by coupling the first and second heat exchangers 220 and 123. In an embodiment, the first and second heat exchangers 220 and 123 may be connected through a pipe as a component constituting the refrigeration cycle. The pipe may be a refrigerant pipe.

The heat exchange device 100 may be disposed in the storehouse body 10.

The heat exchange device 100 may be inserted through the opened front end portion of the device accommodation space 18.

The heat exchange device 100 may slide into the device accommodation space 18.

As another example, the heat exchange device 100 may be fixed at a predetermined position, the storehouse body 10 may be moved toward the heat exchange device 100, and the heat exchange device 100 may be inserted into the device accommodation space 18.

When the heat exchange device 100 is inserted into the device accommodation space 18, the upper portion of the heat exchanger case 200 may be located below the partition wall 50.

The upper end portion of the heat exchanger case 200 may be in a state of being spaced downward apart from the bottom surface of the partition wall 50, and the sealing member 240 installed in the heat exchanger case 200 may be in a state of not being in contact with the bottom surface of the partition wall 50.

A fluid generator may be disposed downstream of the first heat exchanger 220. The fluid generator may include a fan assembly 300. The fan assembly 300 may include the first fan 310. The first fan 310 may be disposed inside the shroud 320.

For example, at least a part of the first fan 310 may be disposed inside the heat exchanger case 200.

However, the present disclosure is not limited thereto, and the first fan 310 may be installed outside the heat exchanger case 200. For example, the first fan 310 may be disposed inside the partition wall 50. As another example, the first fan 310 may be disposed inside the first storage space 15 or inside the duct 30.

In a state in which the heat exchange device 100 is inserted into the device accommodation space 18, the fan assembly 300 may be assembled to the storehouse body 10 through the partition wall 50.

The first fan 310 provided in the fan assembly 300 may be disposed at the outlet side of the first heat exchanger 220.

By moving the heat exchanger case 200 toward the partition wall 50 by a predetermined distance ΔH, the partition wall 50 and the heat exchanger case 200 may be in contact with each other.

When the heat exchanger case 200 moves, the heat exchanger case 200 may be guided by the second portion 132*b* of the storage wall 132, and thus, may be stably moved without shaking.

The heat exchanger case 200 may move until the sealing member 240 comes into contact with the partition wall 50.

While the sealing member 240 is in contact with the partition wall 50, the protruding height of the sealing member 240 may decrease or disappear.

The gap between the heat exchanger case 200 and the partition wall 50 may be sealed by the sealing member 240 to prevent cold air in the heat exchanger case 200 from leaking out from the duct 30.

A means for moving the heat exchanger case 200 toward the partition wall 50 may be variously proposed.

For example, the heat exchanger case 200 may be coupled to the partition wall 50.

As another example, a lifting device may be provided around the heat exchanger case 200 to lift the heat exchanger case 200.

As another example, a hook device may be provided on the heat exchanger case 200 or the storehouse body 10 so that the heat exchanger case 200 is caught on the storehouse body 10.

The fluid in the first storage space 15 may be introduced into the inside of the second storage space, for example, the inside of the heat exchanger case 200, through the inlet portion 51 of the partition wall 50, and may pass through the first heat exchanger 220. In the process of passing through the first heat exchanger 220, the fluid may flow from the front portion to the rear portion of the first heat exchanger 220.

The fluid passing through the first heat exchanger 220 may pass through the first fan 310, and the fluid passing through the first fan 310 may be discharged from the fan assembly 300 through the fan outlet portion 326 of the shroud 320 and may flow into the duct 30.

When the second fan 125 is driven, a passage f3 through which the fluid flows inside or outside the tray 130 via the space defined between the tray 130 and the second wall may be formed.

A fluid fw generated inside the second storage space 16, for example, the heat exchanger case 200 may be collected into the tray 130 through the drain hole 208.

INDUSTRIAL APPLICABILITY

According to an embodiment of the present disclosure, first and second storage spaces are fluidly connected to each other. Therefore, the fluid heat-exchanged in a first heat exchanger may be easily supplied to the first storage space, and the fluid in the first storage space may be easily returned to the second storage space. Therefore, the industrial applicability is remarkable.

The invention claimed is:

1. A storehouse comprising:

a first space configured to provide a space in which goods are stored;

a second space configured to provide a space in which a first heat exchanger is accommodated, the second space being fluidly connected to the first space;

a third space configured to provide a space in which a second heat exchanger is accommodated;

a first wall defining at least a part of the first space;

a second wall defining at least a part of the second space and having a drain hole;

a third wall defining at least a part of the third space; and a tray provided adjacent to the second wall and configured to store fluid discharged from the drain hole, wherein the tray includes a fluid collecting surface and a support wall protruding from the fluid collecting surface to support the second wall.

2. The storehouse of claim 1, wherein the second wall comprises a discharge passage through which fluid is discharged, and wherein the tray includes a tray body having the fluid collecting surface that faces the discharge passage.

3. The storehouse of claim 2, wherein the support wall is disposed between the fluid collecting surface and the second wall such that the second wall is spaced upward apart from the fluid collecting surface by the support wall and is configured to be fixed to the first wall.

4. The storehouse of claim 1, wherein the support wall includes an opened end that faces the second wall.

5. The storehouse of claim 1, wherein a fluid collecting space is formed inside the support wall.

6. The storehouse of claim 5, wherein the support wall includes a support front wall, two support side walls extending from opposing sides of the support front wall, and a support rear wall connecting the two support side walls, and wherein the support front wall, the two support side walls, and the support rear walls define at least a portion of the fluid collection space.

7. The storehouse of claim 5, wherein the support wall forms a flow hole through which fluid stored in the tray is introduced into the fluid collecting space.

8. The storehouse of claim 7, wherein the support wall includes a support front wall, two support side walls extending from opposing sides of the support front wall, and a support rear wall connecting the two support side walls, and wherein the flow hole is formed in at least one of the support side walls.

9. The storehouse of claim 8, wherein the tray includes a tray body, and a storage wall forming an edge of the tray body and protruding from the tray body, and wherein the tray body and the storage wall define at least a portion of the fluid collecting region.

10. The storehouse of claim 9, wherein the storage wall includes a first region having a first height and a second region having a second height greater than the first height, and wherein the second region is configured to restrict a movement of the second wall in at least one direction.

11. The storehouse of claim 1, wherein at least one of the first wall or the second wall defines a device accommodation space configured to accommodate the first heat exchanger, and wherein an extension direction of the support wall corresponds to a first direction in which the first heat exchanger is mounted.

12. The storehouse of claim 11, wherein the first direction extends toward a rear of the first space, and wherein the support includes a support side wall extending obliquely downward toward the rear of the first space.

13. The storehouse of claim 12, wherein a surface of the second wall facing the support wall is formed to be inclined to correspond to a shape of the support side wall.

14. The storehouse of claim 1, further comprising a heat source disposed in the fluid collecting region of the tray.

15. The storehouse of claim 14, wherein the heat source includes a refrigerant pipe, the refrigerant pipe including a discharge pipe of a compressor of a discharge pipe of a condenser.

16. The storehouse of claim 1, wherein the second wall includes a heat exchanger case configured to accommodate the first heat exchanger.

17. The storehouse of claim 16, wherein the heat exchanger case includes a surface forming an opening, and the surface of the heat exchanger case is in contact with the first wall.

18. The storehouse of claim 17, wherein the heat exchanger case includes another surface provided below the surface forming the opening and including the drain hole through which fluid in the second space drains to the tray.

19. A storehouse comprising:

a first space configured to provide a space in which goods are stored;

a second space configured to provide a space in which a first heat exchanger is accommodated, the second space being fluidly connected to the first space;

a third space configured to provide a space in which a second heat exchanger is accommodated;

a first wall defining at least a part of the first space;

a second wall defining at least a part of the second space and having a drain hole;

a third wall defining at least a part of the third space; and a tray provided adjacent to the second wall and configured to store fluid discharged from the drain hole, wherein the tray includes a fluid collecting surface on which a pipe is disposed.

20. A storehouse comprising:

a first space configured to provide a space in which goods are stored;

a second space configured to provide a space in which a first heat exchanger is accommodated, the second space being fluidly connected to the first space;

a third space configured to provide a space in which a second heat exchanger is accommodated;

a first wall defining at least a part of the first space;

a second wall defining at least a part of the second space and having a drain hole;

a third wall defining at least a part of the third space; and a tray provided adjacent to the second wall, wherein the tray includes a tray body and a storage wall protruding from an edge of the tray body, and wherein the tray body and the storage wall define at least a portion of the fluid collecting region in which fluid discharged from the drain hole is stored.

* * * * *